US009879899B2

(12) United States Patent
Wightman

(10) Patent No.: US 9,879,899 B2
(45) Date of Patent: Jan. 30, 2018

(54) SURGED HEAT PUMP SYSTEMS AND METHODS

(71) Applicant: XDX Global, LLC, Arlington Heights, IL (US)

(72) Inventor: David Wightman, Arlington Heights, IL (US)

(73) Assignee: XDX Global, LLC, Arlington Heights, IL (US)

( * ) Notice: Subject to any disclaimer, the term of this patent is extended or adjusted under 35 U.S.C. 154(b) by 0 days.

(21) Appl. No.: 14/689,347

(22) Filed: Apr. 17, 2015

(65) Prior Publication Data

US 2016/0010913 A1 Jan. 14, 2016

Related U.S. Application Data

(63) Continuation of application No. 13/682,102, filed on Nov. 20, 2012, now Pat. No. 9,057,547, which is a (Continued)

(51) Int. Cl.
*F25D 21/04* (2006.01)
*F25B 30/02* (2006.01)

(Continued)

(52) U.S. Cl.
CPC ..... *F25D 21/04* (2013.01); *F25B 30/02* (2013.01); *F25B 41/00* (2013.01); *F25B 47/006* (2013.01);

(Continued)

(58) Field of Classification Search
CPC ..... F25B 41/00; F25B 47/006; F25B 30/02; F25B 13/00; F25B 2313/02741;

(Continued)

(56) References Cited

U.S. PATENT DOCUMENTS 3,677,336 A 7/1972 Moore, Jr.
3,734,173 A 5/1973 Moritz (Continued)

FOREIGN PATENT DOCUMENTS

JP 07103622 4/1995
JP 031459 1/2002

OTHER PUBLICATIONS

International Searching Authority, "International Search Report for PCT/US2011/038301, dated Jan. 18, 2012.", Jan. 18, 2012.

*Primary Examiner* — Mohammad M Ali
(74) *Attorney, Agent, or Firm* — Pitts & Lake, P.C.

(57) ABSTRACT

Surged heat pump systems, devices, and methods are disclosed having refrigerant phase separators that generate at least one surge of vapor phase refrigerant into the inlet of an evaporator during an on cycle of the compressor. This surge of vapor phase refrigerant, having a higher temperature than the liquid phase refrigerant, increases the temperature of the evaporator inlet, thus reducing frost build up in relation to conventional refrigeration systems lacking a surged input of vapor phase refrigerant to the evaporator. The temperature of the vapor phase refrigerant is raised in relation to the liquid phase with heat from the liquid by the phase separation, not by the introduction of energy from another source. The surged heat pump systems may operate in highest heat transfer efficiency mode and/or in one or more higher temperature modes.

20 Claims, 14 Drawing Sheets

Related U.S. Application Data continuation of application No. PCT/US2011/038301, filed on May 27, 2011.

(60) Provisional application No. 61/348,847, filed on May 27, 2010.

(51) Int. Cl.

| | |
|---|---|
| ***F25D 21/06*** | (2006.01) |
| ***F25B 41/00*** | (2006.01) |
| ***F25B 47/00*** | (2006.01) |
| *F25B 13/00* | (2006.01) |

(52) U.S. Cl.

CPC ..... *F25D 21/06* (2013.01); *F25B 13/00* (2013.01); *F25B 2313/02741* (2013.01); *F25B 2400/23* (2013.01); *F25B 2500/01* (2013.01)

(58) Field of Classification Search

CPC .. F25B 2500/01; F25B 2400/23; F25D 21/06; F25D 21/04

USPC ..... 62/81, 277, 324.6

See application file for complete search history.

(56) References Cited

U.S. PATENT DOCUMENTS

| | | | | |
|---|---|---|---|---|
| 3,741,289 | A | 6/1973 | Moore | |
| 3,756,903 | A | 9/1973 | Jones | |
| 4,023,377 | A | 5/1977 | Tomita | |
| 4,167,102 | A * | 9/1979 | Willitts | F25B 5/02 62/152 |
| 4,621,505 | A | 11/1986 | Ares et al. | |
| 4,660,385 | A | 4/1987 | Macriss et al. | |
| 4,825,664 | A * | 5/1989 | Vandervaart | F25B 13/00 62/160 |
| 5,381,665 | A | 1/1995 | Tanaka | |
| 5,388,422 | A * | 2/1995 | Hayashida | F24F 3/065 62/211 |
| 5,755,104 | A * | 5/1998 | Rafalovich | F25B 13/00 62/205 |
| 5,848,537 | A * | 12/1998 | Biancardi | F04C 29/0007 62/324.6 |
| 6,070,420 | A * | 6/2000 | Biancardi | F04C 29/0007 62/114 |
| 6,158,466 | A | 12/2000 | Riefler | |
| 6,185,958 | B1 | 2/2001 | Wightman | |
| 6,230,506 | B1 | 5/2001 | Nishida et al. | |
| 6,237,351 | B1 | 5/2001 | Itoh et al. | |
| 6,301,912 | B1 | 10/2001 | Terai et al. | |
| 6,314,747 | B1 | 11/2001 | Wightman | |
| 6,357,246 | B1 | 3/2002 | Jin | |
| 6,367,279 | B1 | 4/2002 | Jin | |
| 6,389,825 | B1 | 5/2002 | Wightman | |
| 6,393,851 | B1 | 5/2002 | Wightman | |
| 6,397,629 | B2 | 6/2002 | Wightman | |
| 6,401,470 | B1 | 6/2002 | Wightman | |
| 6,401,471 | B1 | 6/2002 | Wightman | |
| 6,418,745 | B1 | 7/2002 | Ratliff | |
| 6,581,398 | B2 | 6/2003 | Wightman | |
| 6,644,052 | B1 | 11/2003 | Wightman | |
| 6,668,569 | B1 | 12/2003 | Jin | |
| 6,679,321 | B2 | 1/2004 | Jin | |
| 6,739,139 | B1 | 5/2004 | Solomon | |
| 6,751,970 | B2 | 6/2004 | Wightman | |
| 6,826,924 | B2 | 12/2004 | Shimoda et al. | |
| 6,857,281 | B2 | 2/2005 | Wightman | |
| 6,862,892 | B1 | 3/2005 | Meyer et al. | |
| 6,915,648 | B2 | 7/2005 | Wightman | |
| 6,915,656 | B2 | 7/2005 | Ratliff | |
| 6,951,117 | B1 | 10/2005 | Wightman | |
| 7,003,964 | B2 | 2/2006 | Solomon | |
| 7,191,604 | B1 | 3/2007 | Wiggs | |
| 7,207,188 | B2 | 4/2007 | Solomon | |
| RE39,625 | E | 5/2007 | Shaw | |
| 7,222,496 | B2 | 5/2007 | Choi et al. | |
| 7,225,627 | B2 | 6/2007 | Wightman | |
| 7,448,229 | B2 | 11/2008 | Chin et al. | |
| 7,464,562 | B2 | 12/2008 | Inoue et al. | |
| 7,543,456 | B2 | 6/2009 | Sinha | |
| 7,578,140 | B1 | 8/2009 | Wiggs | |
| 7,591,145 | B1 | 9/2009 | Wiggs | |
| 7,603,872 | B2 | 10/2009 | Tanaami et al. | |
| 7,607,314 | B2 | 10/2009 | Eisenhour | |
| 7,628,021 | B2 | 12/2009 | McPherson | |
| 7,654,104 | B2 | 2/2010 | Groll et al. | |
| 7,658,072 | B2 | 2/2010 | Masada | |
| 7,658,082 | B2 | 2/2010 | Jagusztyn | |
| 7,661,464 | B2 | 2/2010 | Khrustalev et al. | |
| 7,661,467 | B1 | 2/2010 | Matthys et al. | |
| 7,663,388 | B2 | 2/2010 | Barabi et al. | |
| 7,669,430 | B2 | 3/2010 | Matsui et al. | |
| 2003/0140644 | A1 | 7/2003 | Wightman | |
| 2008/0092569 | A1 | 4/2008 | Doberstein et al. | |

* cited by examiner

SURGED HEAT PUMP SYSTEMS AND METHODS

REFERENCE TO RELATED APPLICATIONS

This application is a continuation of U.S. application Ser. No. 13/682,102 entitled "Surged Heat Pump Systems" filed Nov. 20, 2012, which is a continuation of PCT/US2011/038301 entitled "Surged Heat Pump Systems" filed May 27, 2011, which was published in English and claimed the benefit of U.S. Provisional Application No. 61/348,847 entitled "Surged Heat Pump Systems" as filed May 27, 2010, which are both incorporated by reference in their entirety.

BACKGROUND

Vapor compression systems circulate refrigerant in a closed loop to transfer heat from one external medium to another external medium. Vapor compression systems are used in air-conditioning, heat pump, and refrigeration systems. FIG. 1 depicts a conventional vapor compression heat transfer system 100 that operates though the compression and expansion of a refrigerant fluid. The system 100 transfers heat in one direction from a first external medium 150, through a closed-loop, to a second external medium 160. Fluids include liquid and/or gas phases. Thus, if the first external medium 150 was the indoor air contained by a structure, and the second external medium 160 was the air outside of the structure, the system 100 would cool the indoor air during operation.

A compressor 110 or other compression device reduces the volume of the refrigerant, thus creating a pressure difference that circulates the refrigerant through the loop. The compressor 110 may reduce the volume of the refrigerant mechanically or thermally. The compressed refrigerant is then passed through a condenser 120 or heat exchanger, which increases the surface area between the refrigerant and the second external medium 160. As heat transfers to the second external medium 160 from the refrigerant, the refrigerant contracts in volume.

When heat transfers to the compressed refrigerant from the first external medium 150, the compressed refrigerant expands in volume. This expansion is often facilitated with a metering device 130 including an expansion device and a heat exchanger or evaporator 140. The evaporator 140 increases the surface area between the refrigerant and the first external medium 150, thus increasing the heat transfer between the refrigerant and the first external medium 150. The transfer of heat into the refrigerant from the evaporator 140 causes at least a portion of the expanded refrigerant to undergo a phase change from liquid to gas. Thus, air contacting the surface of the evaporator 140 undergoes a reduction in temperature. The heated refrigerant is then passed back to the compressor 110 and the condenser 120, where at least a portion of the heated refrigerant undergoes a phase change from gas to liquid when heat transfers to the second external medium 160. Thus, air contacting the surface of the condenser 120 undergoes an increase in temperature.

The closed-loop heat transfer system 100 may include other components, such as a compressor discharge line 115 joining the compressor 110 and the condenser 120. The outlet of the condenser 120 may be coupled to a condenser discharge line 125, and may connect to receivers for the storage of fluctuating levels of liquid, filters and/or desiccants for the removal of contaminants, and the like (not shown). The condenser discharge line 125 may circulate the refrigerant to one or more metering devices 130.

The metering device 130 may include one or more expansion devices. The metering device 130 includes the ability to alter the rate of refrigerant flow through the device. An expansion device may be any device capable of expanding, or metering a pressure drop in the refrigerant at a rate compatible with the desired operation of the system 100. Thus, the metering device 130 alters the rate of refrigerant flow, and when including an expansion device, also includes the ability to meter a pressure drop in the refrigerant.

The metering device 130 may provide a static orifice or may adjust during operation of the system 100. The static orifice may be in the form of an adjustable valve that is set and not changed during operation of the system 100. Orifices that adjust during operation may have mechanical or electrical control. For example, mechanical control during operation could be provided by a bi-metal spring that adjusts tension or by a fluid that adjusts the pressure exerted against a diaphragm in response to changes in pressure or temperature. Similarly, electrical control during operation could be provided by a servo motor that changes the orifice in response to the electrical signal from a thermocouple.

Useful metering devices having the ability to expand the refrigerant (meter a pressure drop in the refrigerant) include thermal expansion valves, capillary tubes, fixed and adjustable nozzles, fixed and adjustable orifices, electric expansion valves, automatic expansion valves, manual expansion valves, and the like. Examples of thermal expansion valves include the Sporlan EBSVE-8-GA (one-directional) and the Sporlan RZE-6-GA (bi-directional), as available from Parker Hannifin, Cleveland, Ohio. Examples of capillary tubes include the Sporlan Style F and the Supco BC 1-5, as available from Supco, Allenwood, N.J. Examples of electric expansion valves include the Parker SER 6 and 11, as available from Parker Hannifin, Cleveland, Ohio. Other metering devices may be used.

The refrigerant exiting the expansion portion of the metering device 130 passes through an expanded refrigerant transfer system 135, which may include one or more refrigerant directors 136, before passing to the evaporator 140. The expanded refrigerant transfer system 135 may be incorporated with the metering device 130, such as when the metering device 130 is located close to or integrated with the evaporator 140. Thus, the expansion portion of the metering device 130 may be connected to one or more evaporators by the expanded refrigerant transfer system 135, which may be a single tube or include multiple components. The metering device 130 and the expanded refrigerant transfer system 135 may have fewer or additional components, such as described in U.S. Pat. Nos. 6,751,970 and 6,857,281, for example.

One or more refrigerant directors 136 may be incorporated with the metering device 130, the expanded refrigerant transfer system 135, and/or the evaporator 140. Thus, the functions of the metering device 130 may be split between one or more expansion device and one or more refrigerant directors and may be present, separate from, or integrated with the expanded refrigerant transfer system 135 and/or the evaporator 140. Useful refrigerant directors include tubes, nozzles, fixed and adjustable orifices, distributors, a series of distributor tubes, direction-altering valves, and the like.

The evaporator 140 receives the expanded refrigerant in a substantially liquid state with a small vapor fraction and provides for the transfer of heat to the expanded refrigerant from the first external medium 150 residing outside of the closed-loop heat transfer system 100. Thus, the evaporator or heat exchanger 140 facilitates in the movement of heat from one source, such as ambient temperature air, to a second source, such as the expanded refrigerant. Suitable heat exchangers may take many forms, including copper tubing, plate and frame, shell and tube, cold wall, and the like. Many conventional systems are designed and operated, at least theoretically, to completely convert the liquid portion of the refrigerant to vaporized refrigerant within the evaporator 140. In addition to the heat transfer converting liquid refrigerant to a vapor phase, the vaporized refrigerant may become superheated, thus having a temperature in excess of the refrigerant's boiling temperature and/or increasing the pressure of the refrigerant. The refrigerant exits the evaporator 140 through an evaporator discharge line 145 and returns to the compressor 110.

In conventional vapor compression systems, the expanded refrigerant enters the evaporator 140 at a temperature that is significantly colder than the temperature of the air surrounding the evaporator. As heat transfers to the refrigerant from the evaporator 140, the refrigerant temperature increases in the later or downstream portion of the evaporator 140 to a temperature above that of the air surrounding the evaporator 140. This rather significant temperature difference between the initial or inlet portion of the evaporator 140 and the later or outlet portion of the evaporator 140 may lead to oil retention and frosting problems at the inlet portion.

FIG. 2A and FIG. 2B depict a conventional heat pump system 200 having the capability to transfer heat in two directions. Thus, while system 100 can transfers heat from the first external medium 150 to the second external medium 160, the heat pump system 200 can transfer heat from a first external medium 250 to a second external medium 260 (FIG. 2A) or can transfer heat from the second external medium 260 to the first external medium 250 (FIG. 2B). In this manner, the system 200 may be considered "reversible" in its ability to transfer heat.

In a conventional heat pump implementation, an inside heat exchanger 240 is placed within a conditioned space, while an outside heat exchanger 220 is placed outside of the conditioned space, generally outdoors. The conditioned space may be the interior of a home, vehicle, refrigerator, cooler, freezer, and the like.

In cooling mode, where the system is transferring heat from the conditioned space to the outdoors, the inside heat exchanger 240 is serving as the evaporator, while the outside heat exchanger 220 is serving at the condenser. In reversed, or heat pump mode, where the system is transferring heat from the outdoors to the conditioned space, the inside heat exchanger 240 is serving as the condenser, while the outside heat exchanger 220 is serving at the evaporator. Thus, regardless of operation mode, heat is always being transferred into the evaporator and away from the condenser.

Unlike the one-directional system 100, the bi-directional heat pump system 200 uses a flow reverser 280 and two metering devices 230, 233, which may pass refrigerant in either direction. As the compressor 210 passes refrigerant in one direction, the flow reverser 280 allows either the inside heat exchanger 240 or the outside heat exchanger 220 to feed an evaporator discharge line 245 that feeds the low pressure inlet side of the compressor 210. Thus, the flow reverser 280 switches the system between heating or cooling the first external medium 250. Examples of flow reversers include the Ranco V2 and V6 products, as available from Invensys, Portland House, Bressenden Place, London. Other flow reversers may be used.

At any one time, one of the metering devices is functioning to expand and/or meter a pressure drop in the refrigerant while the second metering device is back-flowing refrigerant and not functioning to expand the refrigerant. Thus, in FIG. 2A where heat is being removed from the first external medium 250 to cool the conditioned space, the metering device 230 is expanding the refrigerant, while the metering device 233 is back-flowing refrigerant. Similarly, in FIG. 2B where heat is being provided from the second external medium 260 to heat the first external medium 250 to the conditioned space, the metering device 233 is expanding the refrigerant while the metering device 230 is back-flowing refrigerant.

If either of the metering devices 230, 233 are not bi-directional, thus lacking the ability to back-flow the refrigerant and maintain the desired performance, one-directional metering devices may be used in combination with bypass loops 271, 272 including one-directional check valves 270, 273, as represented in FIG. 2C (cooling) and in FIG. 2D (heating). Thus, while one metering device expands the refrigerant, the second metering device is bypassed with a bypass loop and a check valve. The check valve prevents refrigerant from back-flowing through the associated one-directional metering device.

A disadvantage of conventional heat pumps is that because they serve two functions (heating and cooling the same conditioned space), they are not optimized for either. One way the heat pump system 200 represented in FIG. 2B provides heat at the inside heat exchanger 240 is by introducing a restriction to refrigerant flow in an expanded refrigerant transfer system 235. While such a restriction could be located anywhere in the expanded refrigerant transfer system 235 allowing for proper operation of the system, the restriction is often incorporated into one or more refrigerant directors 236. By making the refrigerant directors 236 smaller than optimal for cooling, refrigerant reaches a higher temperature and pressure in the inside heat exchanger 240 during heating as it is more difficult for the refrigerant to exit the inside heat exchanger 240. Thus, while the system 200 can provide heat to the indoor space, the cooling efficiency provided by the system is substantially reduced as the restriction also restricts refrigerant from entering the inside heat exchanger 240 during cooling.

In addition to the energy wasted from operating the compressor 210 at a higher pressure than would otherwise be needed for optimal cooling efficiency, as the compressor 210 works against the restriction when heating and when cooling, the operational lifetime of the compressor 210 is reduced in relation to a system where the compressor 210 works harder when heating, but not when cooling.

Although heat pumps are generally used to heat conditioned spaces in temperate climates, heat pumps may be used in colder regions, such as when only electricity is available and resistance coils are undesired. Colder regions are those where winter average low temperatures are about 0° C. and below. Much colder regions are those where winter average low temperatures are about −7° C. and below. As winter average low temperatures decrease from about 0° C., heat pump usage declines significantly. For example, in the much colder regions of the United States, such as the East North Central, West North Central, and Mountain regions, heat pump usage is less than 10% in newer single family homes, while averaging about 47% in the warmer South Atlantic, East South Central, and West South Central regions.

While heat pumps may be used in these colder regions, if the frost built up on the outside heat exchanger 220 during on-cycles of the compressor 210 (heating) does not substantially melt during off-cycles, defrost cycles may be necessary to remove the frost and restore heat transfer efficiency to the system 200. As the temperature of the outside heat exchanger 220 drops as heat is transferred to the inside heat exchanger 240, the ability of the outside heat exchanger 220 to extract heat from the outdoors, while maintaining a surface temperature above 0° C. to prevent frosting, decreases with lower outdoor air temperatures.

Thus, in heating mode, where the outside heat exchanger 220 is functioning as an evaporator, frosting of the outside heat exchanger 220 can be a significant problem requiring frequent defrosting. Such frosting often is caused by expanded refrigerant in the initial portion of the outside heat exchanger 220 being at a temperature below the dew point of the outside air, which results in moisture condensation and freezing on the outside heat exchanger 220 during heating operation. Thus, as with an indoor evaporator used for cooling, the outside heat exchanger 220 of a heat pump system can freeze during heating. In fact, the problem can be more severe for the outside heat exchanger of a heat pump system as the system cannot significantly alter the humidity content of the outside air and the outdoor air temperature when heating is generally lower than the conditioned space air temperature when cooling.

As frost encloses a portion of the outside heat exchanger's surface during heating, the frosted surface insulates the coils of the outside heat exchanger 220 from direct contact with the outdoor air. Consequently, airflow over and/or through the outside heat exchanger 220 is reduced and the ability of the outside heat exchanger 220 to absorb heat from the outdoors (heating efficiency) decreases. Thus, the amount of heat that the heat pump system 200 can transfer from outdoors to the conditioned space decreases for the energy consumed (a reduction in heating efficiency) and the rate at which the system 200 can transfer heat from outdoors to the conditioned space also decreases. This reduction in the rate of heat transfer results in a decrease in the temperature of the heated air that is provided to the conditioned space.

Conventional heat pump systems may passively defrost by turning off the compressor 210 or may actively defrost by applying heat to the outside heat exchanger 220 during defrost cycles. Whether one or both methods are used, defrosting requires a larger vapor compression system than would be required if the system did not have to suspend the desired direction of heat transfer to defrost.

As the compressor 210 is off during passive defrosting, the rate at which the system 200 can heat the conditioned space is reduced. Passive defrost cycles may be controlled by a simple timing mechanism, such as when the compressor 210 remains on for 30% of a selected time period, regardless of the amount of heat desired for the conditioned space. Passive defrost cycles also may be controlled by electronic circuits that monitor the performance of the outside heat exchanger 220 and attempt to maximize operation of the compressor 210 in relation to the efficiency lost due to frosting of the outside heat exchanger 220.

For active defrosting, heat is generally transferred from the conditioned space to the outside heat exchanger 220 by transferring heat that the system 200 previously transferred from the outdoors to the conditioned back to the outside heat exchanger 220. Thus, the heat pump system is operated in cooling mode even though the conditioned space requires heating, when actively defrosting the outside heat exchanger 220 and consumes energy to move heat back to where it started, outdoors. Additionally, as heated air from the conditioned space is blown across the inside heat exchanger 240 during active defrosting to prevent icing of the inside heat exchanger 240, supplemental heat may be provided by inductance coils or other means to prevent the system from providing cold air to the conditioned space. Thus, a conventional heat pump system requiring frequent defrosting often operates as a forced-air electric induction heater, which must heat the outside heat exchanger 220 in addition to the conditioned space. This results in any theoretical energy efficiency gain obtained from the transfer of heat from the outdoors to the conditioned space to be lost.

Accordingly, there is an ongoing need for heat pump systems having improved efficiency when cooling and heating. It also would be desirable for heat pump systems to have an enhanced resistance to outside heat exchanger frosting during heating, especially in colder regions. The disclosed systems, methods, and devices overcome at least one of the disadvantages associated with conventional heat pump systems.

SUMMARY

A heat pump system has a phase separator that provides one or more surges of a vapor phase of a refrigerant into an evaporator while transferring heat from a conditioned space. The surges of the vapor phase have a higher temperature than the liquid phase of the refrigerant, and thus heat the evaporator to remove frost. The system may include a flow-regulating member to assist in the production of friction-heat during heating operation.

A heat pump system has at least two phase separators providing one or more surges of a vapor phase of a refrigerant into an evaporator located inside a conditioned space and into an evaporator located outside of the conditioned space during heat transfer to or from the conditioned space. The surges of the vapor phase have a higher temperature than the liquid phase of the refrigerant, and thus heat either evaporator to remove frost. The system may include a flow-regulating member to assist in the production of friction-heat during heating operation. The system may be operated so the refrigerant exiting the evaporator located outside of the living space does or does not include a liquid phase.

BRIEF DESCRIPTION OF THE DRAWINGS

The invention may be better understood with reference to the following drawings and description. The components in the figures are not necessarily to scale, emphasis instead being placed upon illustrating the principles of the invention.

DETAILED DESCRIPTION

Surged vapor compression heat pump systems include refrigerant phase separators that generate at least one surge of vapor phase refrigerant into the inlet of an evaporator. The evaporator may be located inside a conditioned space or outdoors. The surges are generated by operating the phase separator at a refrigerant mass flow rate that is responsive to the design and dimensions of the phase separator and the heat transfer capacity of the refrigerant. The one or more surges may be generated during an on-cycle of the compressor.

The surges of vapor phase refrigerant may have a higher temperature than the liquid phase refrigerant. In relation to the original temperature of the expanded refrigerant supplied to the phase separator, the liquid resulting from the phase separator will be cooler and the vapor resulting from the phase separator will be hotter than the original temperature of the expanded refrigerant. Thus, the temperature of the vapor is raised with heat from the liquid by the phase separation, not by the introduction of energy from another source.

The surges may increase the temperature of the initial or inlet portion of the evaporator, thus reducing frost build-up in relation to conventional heat pump systems lacking a surged input of vapor phase refrigerant to the evaporator. Reduced frost build-up may be especially advantageous for heating in colder regions as the need to defrost with additional heat, such as from the compressor, heating coils, and the like, may be reduced or eliminated.

By bypassing the phase separator that feeds the inside heat exchanger, the system may provide high heat transfer efficiency during cooling while providing heat to the conditioned space during heating. By providing surged evaporator operation to both the conditioned space and the outdoors, heat transfer efficiency may be increased both to and from the conditioned space. By providing isolated full and partial surge circuits for the outside heat exchanger, the system may provide a highest heat transfer efficiency mode and a higher temperature mode, while reducing the need to increase refrigerant pressure at the compressor during heating.

Figure 1:
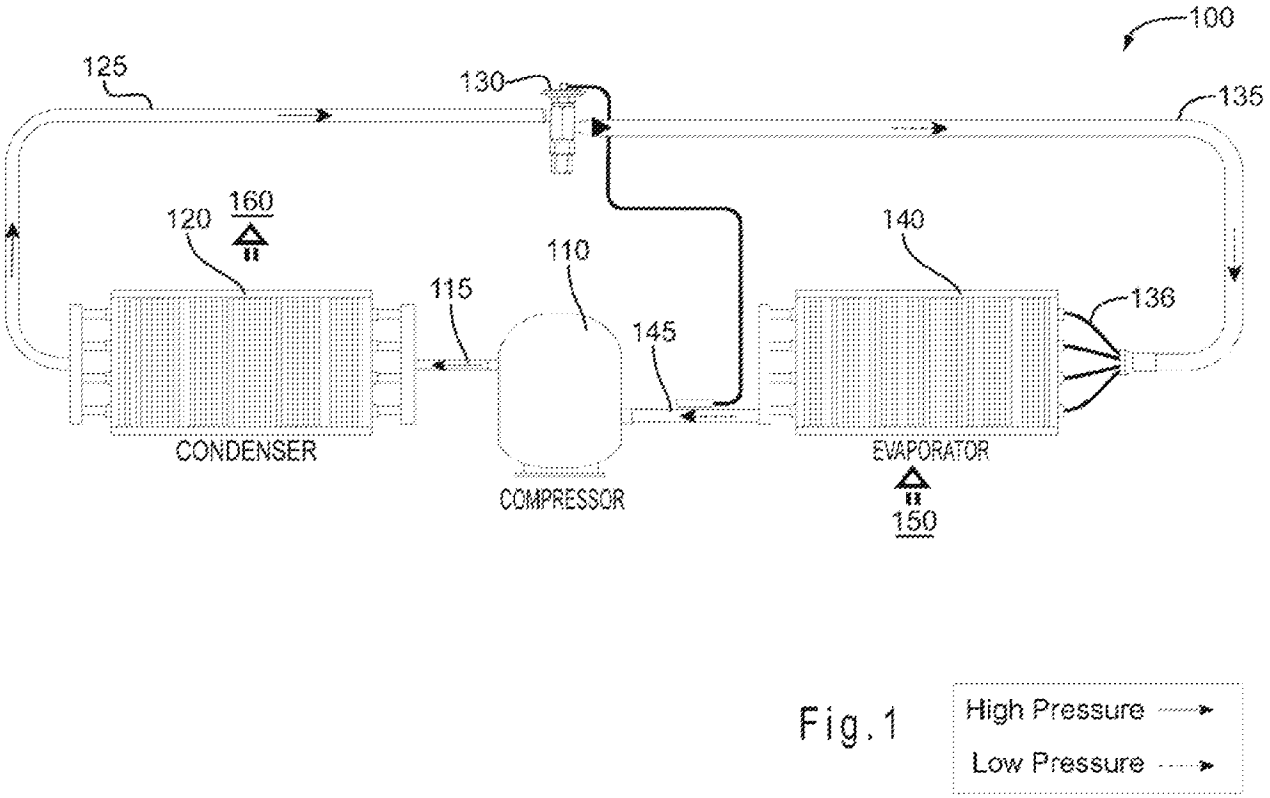
FIG. 1 depicts a schematic diagram of a conventional vapor compression heat transfer system according to the prior art.
Figure 2A:
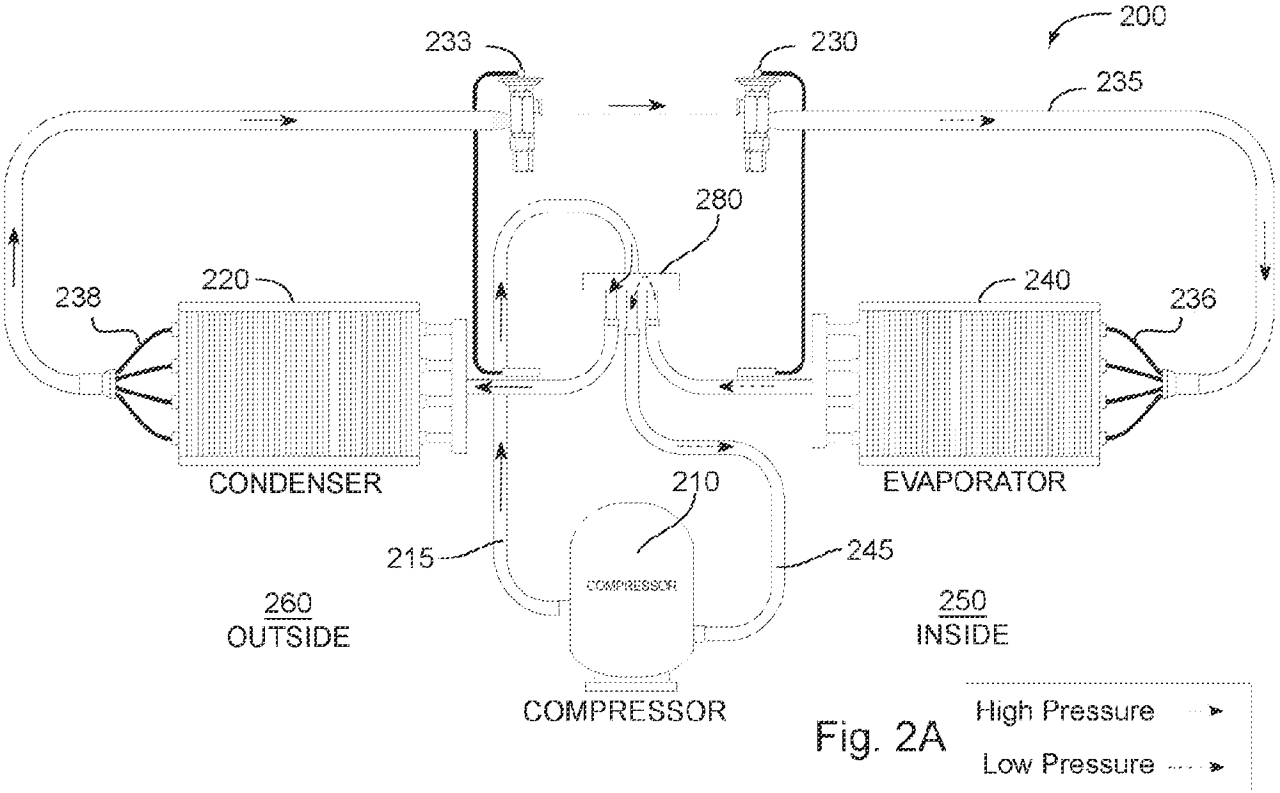
FIG. 2A depicts a schematic diagram of a conventional heat pump system including bi-directional metering devices providing cooling to a conditioned space.
Figure 2B:
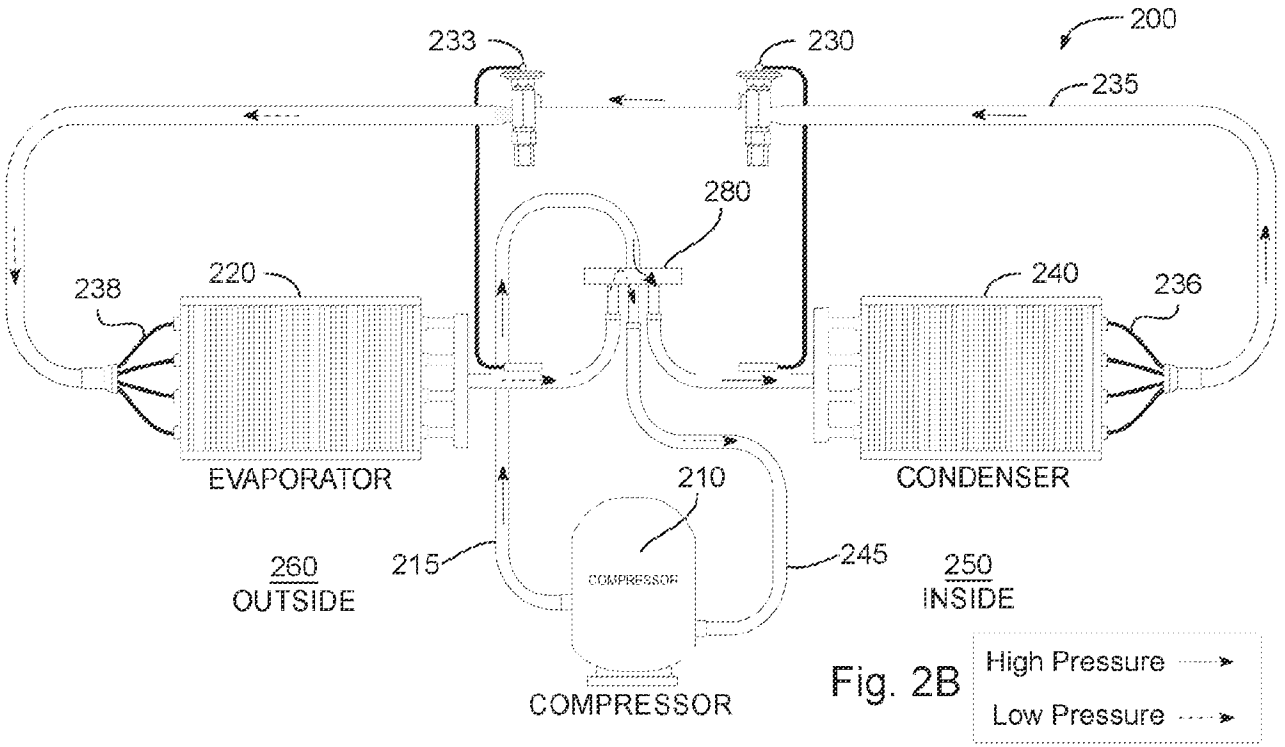
FIG. 2B depicts a schematic diagram of a conventional heat pump system including bi-directional metering devices providing heating to a conditioned space.
Figure 2C:
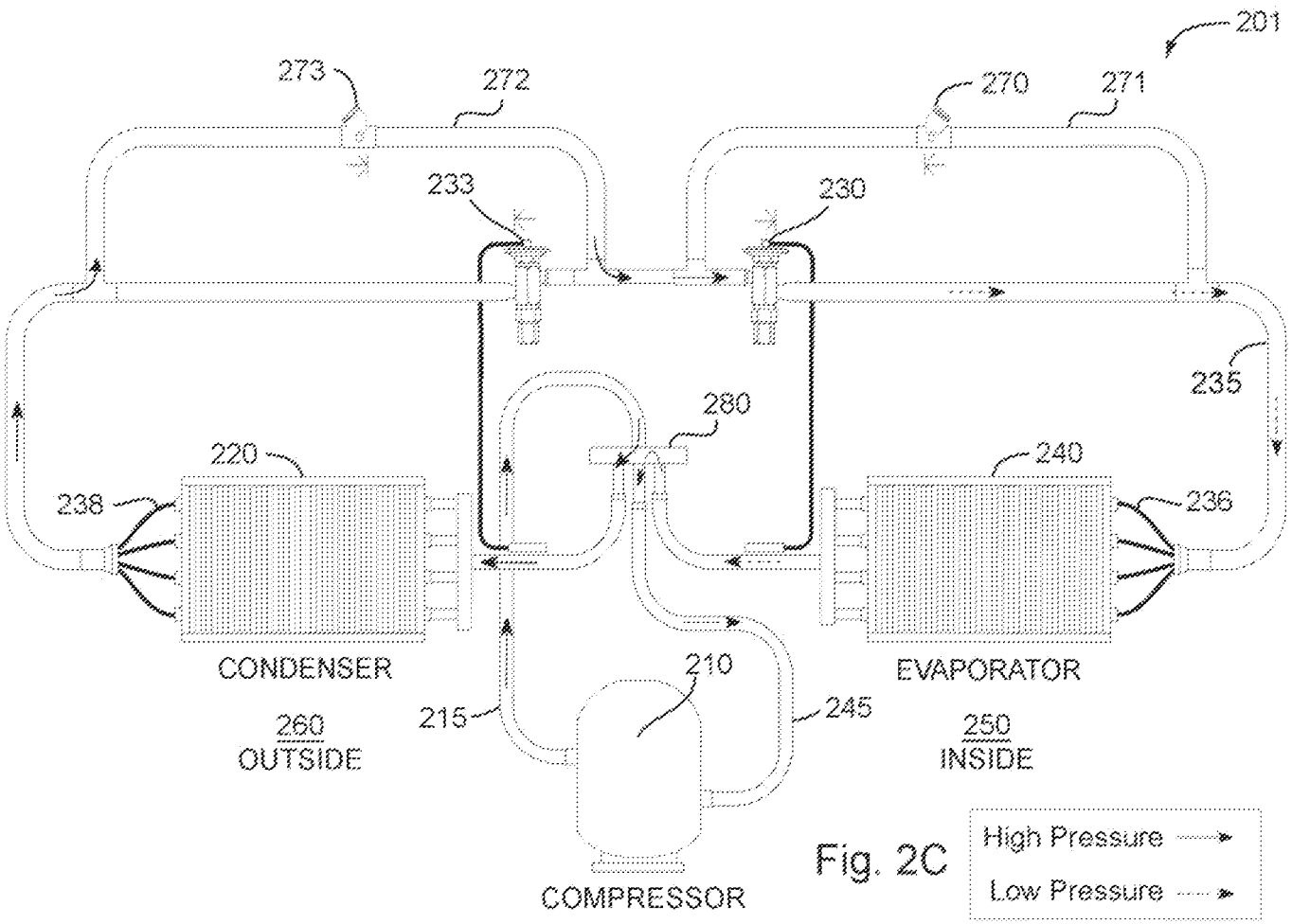
FIG. 2C depicts a schematic diagram of a conventional heat pump system including bypass loops and one-directional valves providing cooling to a conditioned space.
Figure 2D:
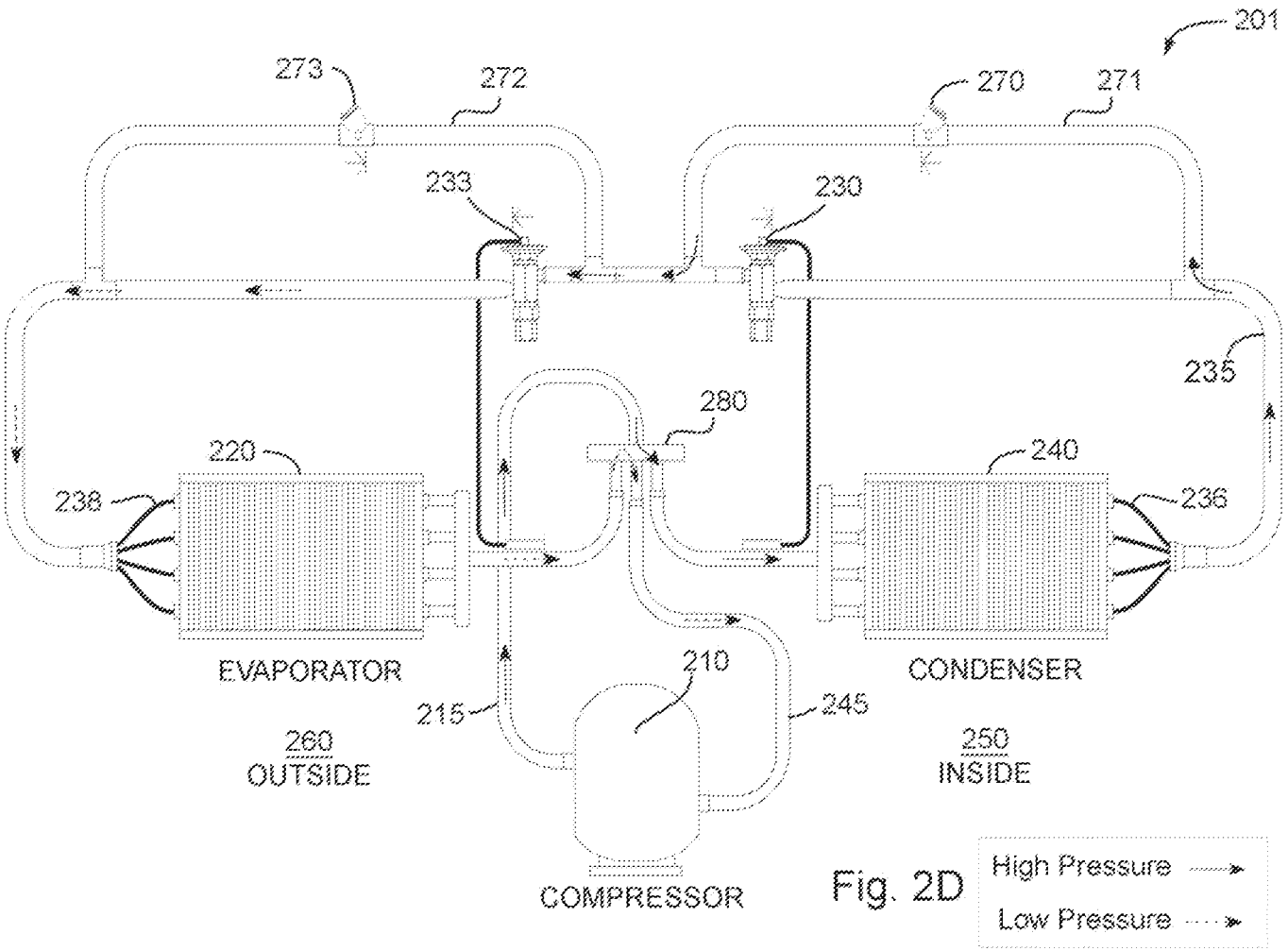
FIG. 2D depicts a schematic diagram of a conventional heat pump system including bypass loops and one-directional valves providing heating to a conditioned space.
Figure 3A:
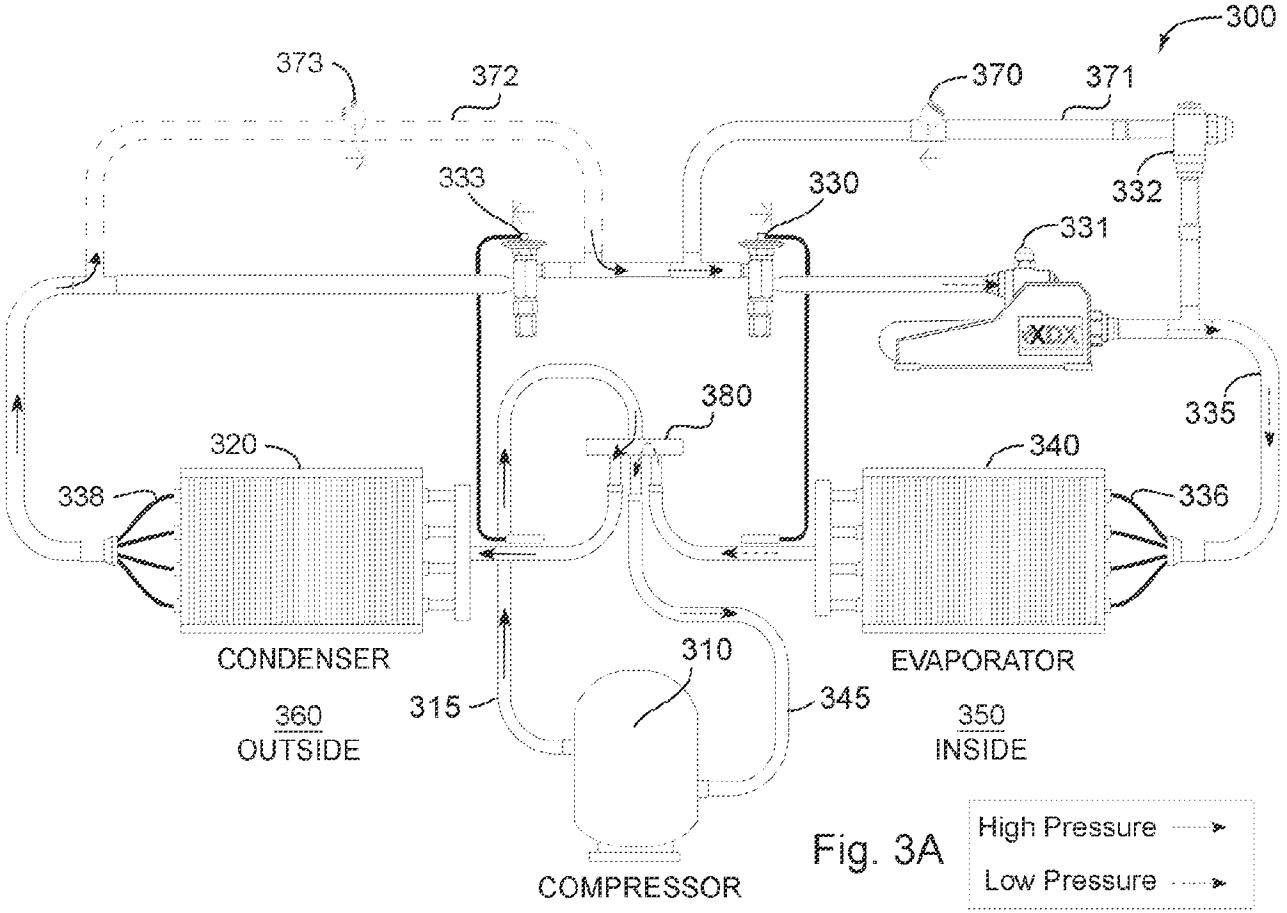
FIG. 3A depicts a schematic diagram of a surged inside heat exchanger heat pump system including a flow-regulating member providing cooling to a conditioned space.
Figure 3B:
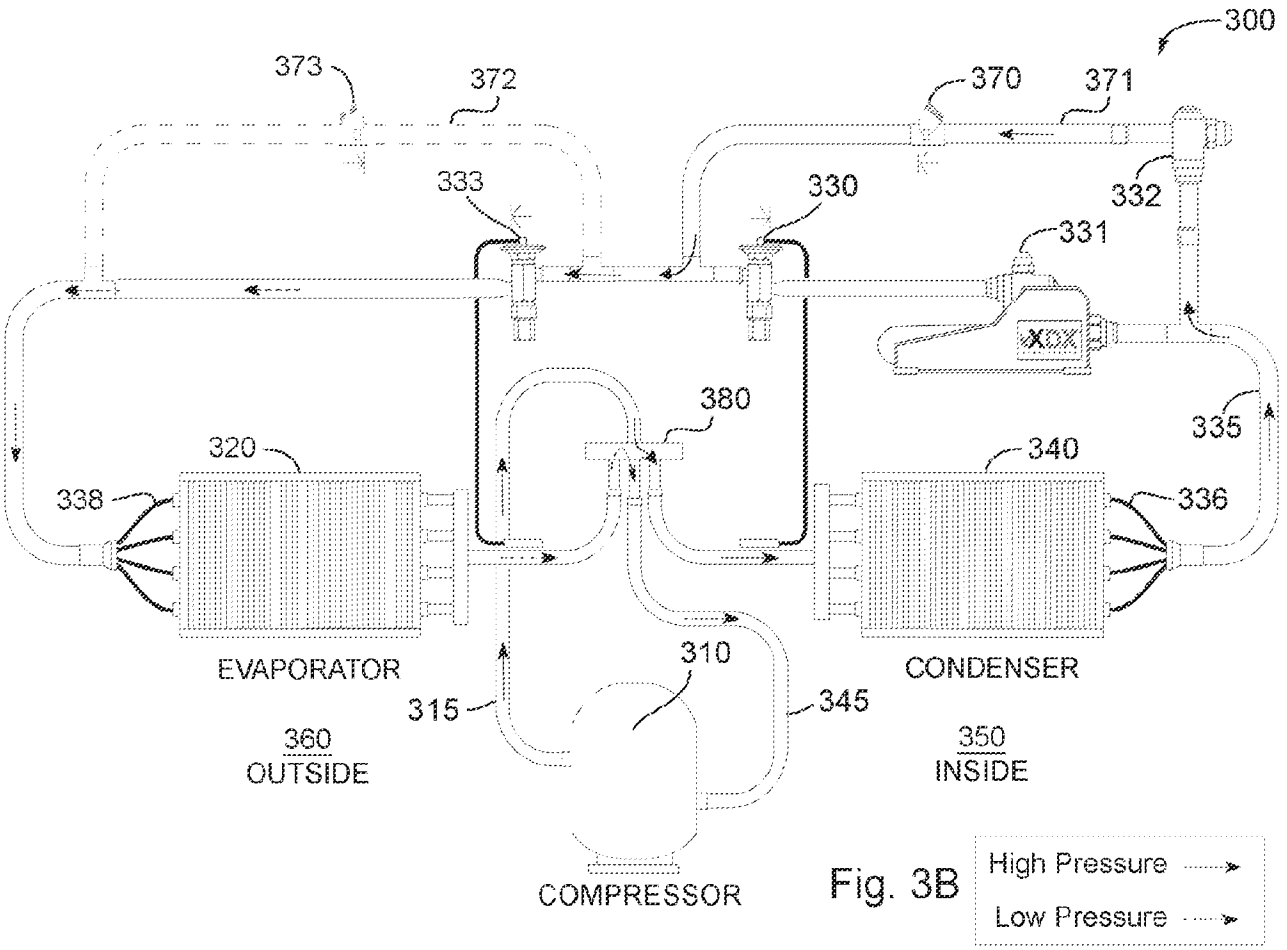
FIG. 3B depicts a schematic diagram of a surged inside heat exchanger heat pump system including a flow-regulating member providing heating to a conditioned space.

In FIG. 3A and FIG. 3B, a phase separator 331 and a flow-regulating member 332 are integrated into the conventional heat pump system of FIG. 2C and FIG. 2D, respectively, to provide a surged cooling heat pump system 300. FIG. 3A represents the system 300 providing cooling to the conditioned space, while FIG. 3B represents the system 300 providing heating to the conditioned space.

The system 300 includes a compressor 310, an outside heat exchanger 320, metering devices 330, 333, and an inside heat exchanger 340. As the compressor 310 passes refrigerant in one direction, the flow reverser 380 allows either the inside heat exchanger 340 or the outside heat exchanger 320 to feed an evaporator discharge line 345 that feeds the low pressure inlet side of the compressor 310. A flow-regulating member 332 may be inserted in bypass loop 371 between the one-directional check valve 370 and the phase separator 331. The flow-regulating member may provide the desired restriction to refrigerant exiting the inside heat exchanger 340 when it is functioning as a condenser in heating mode. The phase separator 331 feeds the indoor heat exchanger 340 when it is functioning as an evaporator in cooling mode. If the metering device 333 does not permit bi-directional refrigerant flow, the metering device 333 may be bypassed with optional bypass loop 372 and optional one-directional check valve 373. Thus, the outside portion of the system 300 may be configured as in the conventional systems 200 or 201, as previously discussed with regard to FIG. 2C and FIG. 2D. The surged cooling heat pump system 300 may have fewer or additional components.

The phase separator 331 may be integrated with or separate from the metering device 330. When separate, the phase separator may include a flow-regulating member to adapt the refrigerant flow from the metering device 330 to the phase separator 331. The phase separator 331 may be integrated after the expansion portion of the metering device 330 and before the inside heat exchanger 340. The phase separator 331 may be integrated with the metering device 330 in any way compatible with the desired operating parameters of the system. The phase separator 331 is positioned before or at the inlet to the inside heat exchanger 340. Additional components, such as fixed or adjustable nozzles, refrigerant distributors, refrigerant distributor feed lines, heat exchangers that alter the condition of the refrigerant, and one or more valves, may be positioned between the phase separator 331 and the inside heat exchanger 340. However, such additional components are preferably configured to not substantially interfere with the surged operation of the system 300. The metering device 330 and the phase separator 331 may have fewer or additional components.

The phase separator 331 includes a body portion defining a separator inlet, a separator outlet, and a refrigerant storage chamber. The inlet and outlet may be arranged where angle is from about 40° to about 110°. The longitudinal dimension of the chamber may be parallel to the separator outlet; however, other configurations may be used. The longitudinal dimension may be from about 4 to 5.5 times the separator outlet diameter and from about 6 to 8.5 times the separator inlet diameter. The storage chamber has a volume defined by the longitudinal dimension and the chamber diameter.

The phase separator 331 provides for at least partial separation of the liquid and vapor of the expanded refrigerant from the metering device 330 before the refrigerant enters a heat exchanger, such as the inside heat exchanger 340. In addition to the design and dimensions of the phase separator 331, the separation of the liquid and vapor phases may be affected by other factors, including the operating parameters of the compressor 310, the metering device 330, the expanded refrigerant transfer system 335, additional pumps, flow enhancers, flow restrictors, and the like.

Vapor phase refrigerant surges may be provided to the initial portion of the inside heat exchanger 340 by equipping the system 300 with a phase separator having a ratio of the separator inlet diameter to the separator outlet diameter of about 1:1.4 to 4.3 or of about 1:1.4 to 2.1; a ratio of the separator inlet diameter to the separator longitudinal dimension of about 1:7 to 13; and a ratio of the separator inlet diameter to a refrigerant mass flow rate of about 1:1 to 12. While these ratios are expressed in units of centimeters for length and in units of kg/hr for mass flow rate, other ratios may be used including those with other units of length and mass flow rate.

During separation of the expanded refrigerant, a net cooling of the liquid and a net heating of the vapor occurs. Thus, in relation to the original temperature of the expanded refrigerant supplied to the phase separator 331, the liquid resulting from the phase separator 331 will be cooler and the vapor resulting from the phase separator 331 will be hotter than the original temperature of the expanded refrigerant. Thus, the temperature of the vapor is raised with heat from the liquid by the phase separation, not by the introduction of energy from another source. In this manner, the need to introduce to the evaporator refrigerant vapor or liquid heated by another source, such as the compressor, heating coils, and the like during active defrost may be reduced or eliminated by using the phase separator 331 during heat transfer to or from the conditioned space.

During a surge, the temperature of the initial portion of the inside heat exchanger 340 may rise to within at most about 1° C. of ambient temperature. Furthermore, during the surge, the initial portion of the inside heat exchanger 340 may become warmer than the dew point of the ambient air surrounding the heat exchanger. Also during the surge, the refrigerant in the initial portion of the inside heat exchanger 340 may be at least 0.5° C. warmer, or may be at least 2° C. warmer, than the dew point of the air surrounding the heat exchanger.

By operating the phase separator 331 to introduce surges of refrigerant into an evaporator, such as the inside heat exchanger 340 of FIG. 3A, which are substantially vapor between operating periods of introducing refrigerant into the evaporator that include a substantially increased liquid component in relation to the vapor surges, the surged cooling heat pump system 300 is provided. The system 300 achieves a vapor surge frequency during operation of the compressor 310 that is preferred for a specific heat transfer application based on the design and dimensions of the phase separator 331 and the rate at which refrigerant is provided to the phase separator 331.

The ratio of the phase separator inlet diameter to the phase separator longitudinal dimension may be increased or decreased from these ratios until the system 300 no longer provides the desired surge rate. Thus, by altering the ratio of the separator inlet diameter to the longitudinal dimension, the surge frequency of the system 300 may be altered until it no longer provides the desired surge effect. Depending on the other variables, these ratios of the separator inlet diameter to the refrigerant mass flow rate may be increased or reduced until surging stops. These ratios of the separator inlet diameter to the refrigerant mass flow rate may be increased or reduced until either surging stops or the desired cooling is no longer provided. A person of ordinary skill in the art may determine other ratios to provide a desired surge or surges, a desired surge frequency, cooling, combinations thereof, and the like.

By at least partially separating the liquid and vapor of the expanded refrigerant before introduction to the inlet of the evaporator and surging substantially vapor refrigerant into the evaporator, the system 300 creates temperature fluctuations in the initial portion of the evaporator. The initial or inlet portion of the evaporator may be the initial 30% of the evaporator volume nearest the inlet. The initial or inlet portion of the evaporator may be the initial 20% of the evaporator volume nearest the inlet. Other inlet portions of the evaporator may be used. The initial or inlet portion of the evaporator that experiences the temperature fluctuations may be at most about 10% of the evaporator volume. The system 300 may be operated to prevent or essentially eliminate temperature fluctuations in the evaporator responsive to vapor surges after the initial or inlet portion of the evaporator. Without the cooling capacity of the liquid, the vapor surges result in a positive fluctuation in the temperature of the initial portion of the evaporator.

When the system 300 is operated in cooling mode as represented in FIG. 3A, the substantially vapor surges of refrigerant provided to the initial portion of the inside heat exchanger 340 may be at least 50% vapor (mass vapor refrigerant/mass liquid refrigerant). The surged system 300 also may be operated to provide vapor surges of refrigerant that are at least 75% or at least 90% vapor to the initial portion of the inside heat exchanger 340. Such surges may result in the intermittent peak temperatures reached by the initial portion of the evaporator being within at most about 5° C. of the temperature of the first external medium 350. The intermittent peak temperatures reached by the initial portion of the evaporator also may be within at most about 2.5° C. of the temperature of the first external medium 350. These intermittent peak temperatures preferably are warmer than the dew point of the air within the conditioned space. Other intermittent peak temperatures may be reached.

When operated in cooling mode as represented in FIG. 3A, the surged cooling heat pump system 300 also may be operated to provide an average heat transfer coefficient from about 1.9 $Kcal_{th}$ $h^{-1}$ $m_{-2}$° $C.^{-1}$ to about 4.4 $Kcal_{th}$ $h^{-1}$ $m^{-2}$° $C.^{-1}$ from the initial portion to the outlet portion of the inside heat exchanger 340. The average heat transfer coefficient is determined by measuring the heat transfer coefficient at a minimum of 5 points from the beginning to the end of the inside heat exchanger and averaging the resulting coefficients. This heat transfer performance of the system 300 during cooling is a substantial improvement in relation to conventional non-surged cooling heat pump systems where the initial portion of the inside heat exchanger has a heat transfer coefficient below about 1.9 $Kcal_{th}$ $h^{-1}$ $m_{-2}$° $C.^{-1}$ at the initial portion of the inside heat exchanger coil and a heat transfer coefficient below about 0.5 $Kcal_{th}$ $h^{-1}$ $m^{-2}$° $C.^{-1}$ at the portion of the inside heat exchanger before the outlet.

In addition to raising the average temperature of the initial portion of an evaporator while the compressor 310 is operating in relation to a conventional heat pump system, the initial portion of the evaporator of the system 300 experiences intermittent peak temperatures responsive to the vapor surges that may nearly equal or be higher than the external medium, such as air, surrounding the evaporator. The intermittent peak temperatures experienced by the initial portion of the evaporator reduce the tendency of this portion of the evaporator to frost. The intermittent peak temperatures also may provide for at least a portion of any frost that does form on the initial portion of the evaporator during operation of the compressor 310 to melt or sublimate, thus being removed from the evaporator.

As the intermittent increases in temperature from the vapor surges substantially affect the initial portion of the inside heat exchanger 340, which is most likely to frost, the average operating temperature throughout the inside heat exchanger 340 may be reduced in relation to a conventional heat pump system during cooling mode, without increasing the propensity of the initial portion of the inside heat exchanger 340 to frost. Thus, the surged heat pump system 300 may reduce the need for defrosting, whether provided by longer periods of the compressor 310 not operating or by active methods of introducing heat to the evaporator 340 in relation to a conventional heat pump system, while also allowing for increased cooling efficiency from a lower average temperature throughout the inside heat exchanger 340.

In addition to the benefit of intermittent temperature increases at the initial portion of the evaporator, the ability of the phase separator 331 to at least partially separate the vapor and liquid portions of the refrigerant before introduction to the evaporator provides additional advantages. For example, the system 300 may experience higher pressures within the evaporator when the compressor 310 is operating in relation to conventional heat pump systems that do not at least partially separate the vapor and liquid portions of the refrigerant before introduction to the evaporator during cooling. These higher pressures within the evaporator may provide enhanced heat transfer efficiency to the system 300, as a larger volume of refrigerant may be in the evaporator than would be present in a conventional heat pump system. This increase in evaporator (inside heat exchanger 340) operating pressure also may allow for lower compression ratios during cooling, thus allowing for less energy consumption and a longer lifespan for system components.

In addition to higher evaporator pressures, the mass velocity of the refrigerant through the evaporator may be increased by at least partially separating the vapor and liquid portions of the refrigerant before introduction to the evaporator in relation to conventional heat pump systems that do not at least partially separate the vapor and liquid portions of the refrigerant before introduction to the evaporator. This higher mass velocity of the refrigerant in the evaporator may provide enhanced heat transfer efficiency to the surged cooling heat pump system 300, as more refrigerant passes through the evaporator in a given time than for a conventional heat pump system.

The at least partial separation of the vapor and liquid portions of the refrigerant before introduction to the evaporator also may provide for a temperature decrease in the liquid portion of the refrigerant. Such a decrease may provide more cooling capacity to the liquid portion of the refrigerant in relation to the vapor portion, thus, increasing the total heat transferred by the refrigerant traveling through the evaporator. In this manner the same mass of refrigerant traveling through the evaporator may absorb more heat than in a conventional heat pump system during cooling.

The ability to at least partially separate the vapor and liquid portions of the refrigerant before introduction to the evaporator also may provide for partial as opposed to complete dry-out of the refrigerant at the exit of the evaporator. Thus, by tuning the parameters of the vapor and liquid portions of the refrigerant introduced to the evaporator, a small liquid portion may remain in the refrigerant exiting the evaporator. By maintaining a liquid portion of refrigerant throughout the evaporator, the heat transfer efficiency of the system may be improved. This decrease in evaporator (inside heat exchanger 340) temperature also may allow for lower heat pressures at the condenser (outside heat exchanger 320) during cooling, thus allowing for less energy consumption and a longer lifespan for system components. Thus, in relation to a conventional heat pump system, the same sized evaporator (inside heat exchanger) may be able to transfer more heat from the conditioned space to the outdoors.

At least partially separating the vapor and liquid portions of the refrigerant before introduction to the evaporator also may result in a refrigerant mass velocity sufficient to coat with liquid refrigerant an interior circumference of the tubing forming the refrigerant directors 236, refrigerant transfer system, and/or initial portion of the evaporator following the metering device. While occurring, the total refrigerant mass within the initial portion of the evaporator is from about 30% to about 95% vapor (mass/mass). If the liquid coating of the circumference is lost, the coating will return when the about 30% to the about 95% vapor/liquid ratio returns. In this way, improved heat transfer efficiency may be provided at the initial portion of the evaporator in relation to conventional heat pump systems lacking the liquid coating after the phase separator when cooling. A more detailed discussion of cooling an inside space using a phase separator to provide surged operation to an inside evaporator may be found in Intl. App. No. PCT/US09/44112, filed May 15, 2009 and titled "Surged Vapor Compression Heat Transfer System with Reduced Defrost," which is incorporated by reference in its entirety.

For the phase separator 331 to provide these benefits during cooling, the additional restriction added to the expanded refrigerant transfer system 335 of a conventional heat pump system cannot be present in a way that substantially interferes with phase separation and the resulting surged evaporator operation. Thus, to provide the benefits of surged operation when cooling the conditioned space, the conventional restriction, such as undersized refrigerant directors 336, may not be used. To maintain the benefits from surged operation of the indoor heat exchanger 340 during cooling (FIG. 3A), the desired increase in refrigerant pressure in the inside heat exchanger 340 (FIG. 3B) may be provided by bypassing the phase separator 331 during heating with the bypass loop 371, one-directional check valve 370, and the flow-regulating member 332. In this manner, the flow-regulating member 332 introduces a restriction to refrigerant exiting the inside heat exchanger 340 during heating that does not substantially interfere with refrigerant flow during cooling. Thus, the appropriate restriction to refrigerant flowing from the indoor heat exchanger 340 may be chosen for heating performance, without considering the reduction in cooling performance that otherwise would result.

While adjustability is not required, the flow-regulating member 332 is preferably adjustable, such as described in U.S. Pat. Nos. 6,401,470; 6,857,281; 6,915,648, and the like. The flow-regulating member also may be electrically or mechanically controlled to actively implement the desired restriction into the heat pump system 300 during heating operation. If controlled, the restriction may be increased to increase the temperature of the inside heat exchanger 340 in response to the temperature of the outside air, the air entering the inside heat exchanger 340, the air leaving the inside heat exchanger 340, the air being returned to the inside heat exchanger 340, and the like. Conversely, the restriction provided by the controlled flow-regulating member may be reduced to protect the compressor 310 or to increase energy efficiency in response to the temperature of the compressor 310, the amperage draw of the compressor 310, the line pressure between the compressor 310 and the inside heat exchanger 340, and the like.

While shown separately in FIG. 3A and FIG. 3B, the one-direction check valve 370 and the flow-regulating member 332 may be incorporated into a single housing and the like. Although shown to the right of the one-direction check valve 370 in FIG. 3A and FIG. 3B, the flow-regulating member 332 may be incorporated anywhere in the high-pressure line of FIG. 3B (heating) that does not substantially interfere with the operation of the phase separator 331 during cooling—including location on either side of the one-direction check valve 370.

Examples of one-directional check valves that may be used in the system 300 to prevent refrigerant from back-flowing through the phase separator 331 include the Parker 274037-12, available from Parker Hannifin, and the Superior 900MA-10S, as available from Superior Valve Co., Houston, Tex. In addition to devices sold as check valves, any device compatible with the operation of the system could be used that substantially prevents refrigerant from back-flowing through the phase separator 331. For example, an on-off type solenoid valve under electrical control or a valve that responds to pressure differentials could be used. As the refrigerant will follow the path of least resistance through the lines of the heat pump system, devices that make the back-flow of refrigerant through the phase separator 331 less favorable in relation to the desired path also may be substituted for the check valve.

Figure 4A:
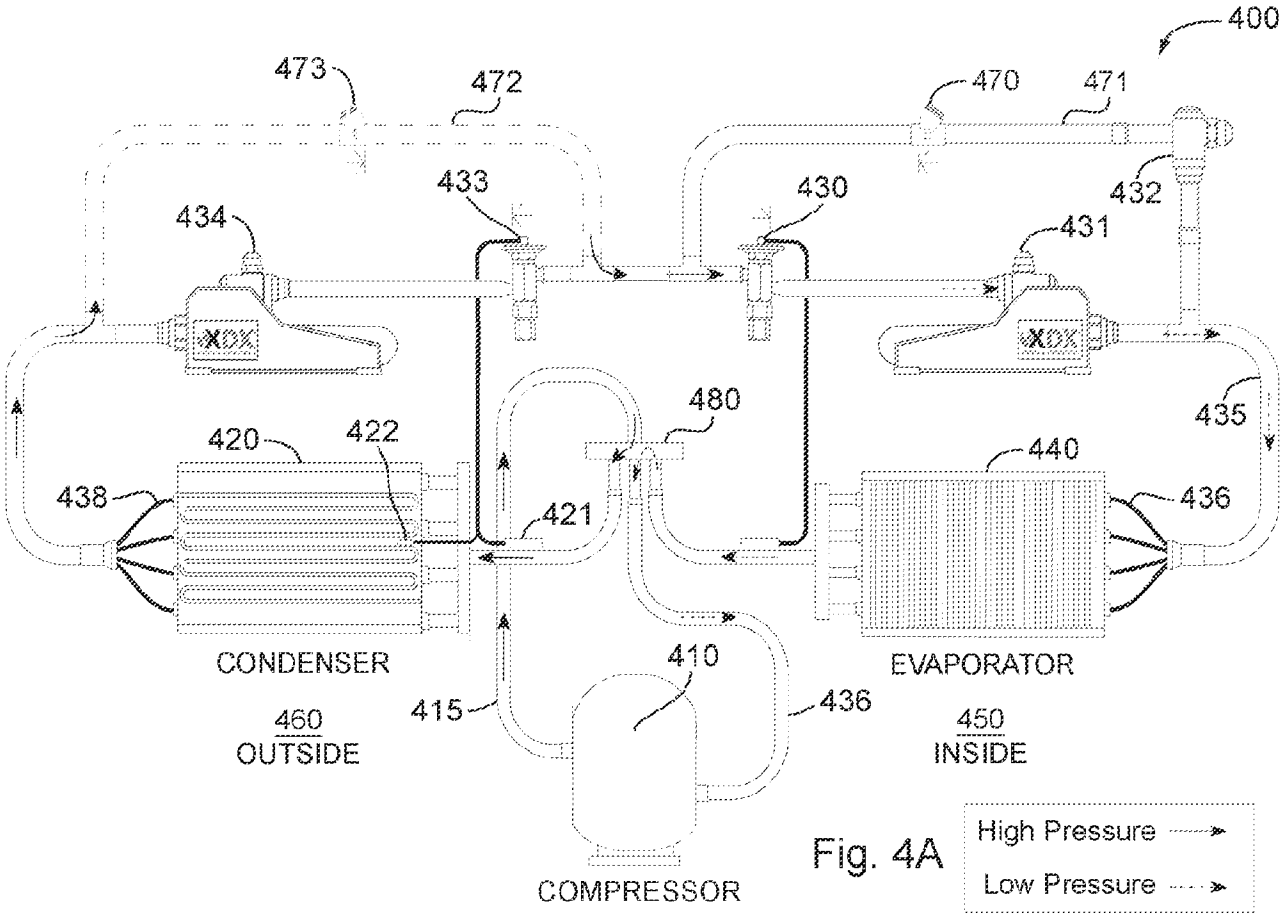
FIG. 4A depicts the schematic diagram of the heat pump system of FIG. 3A as modified with a phase separator capable of providing refrigerant to an outside heat exchanger during cooling.
Figure 4B:
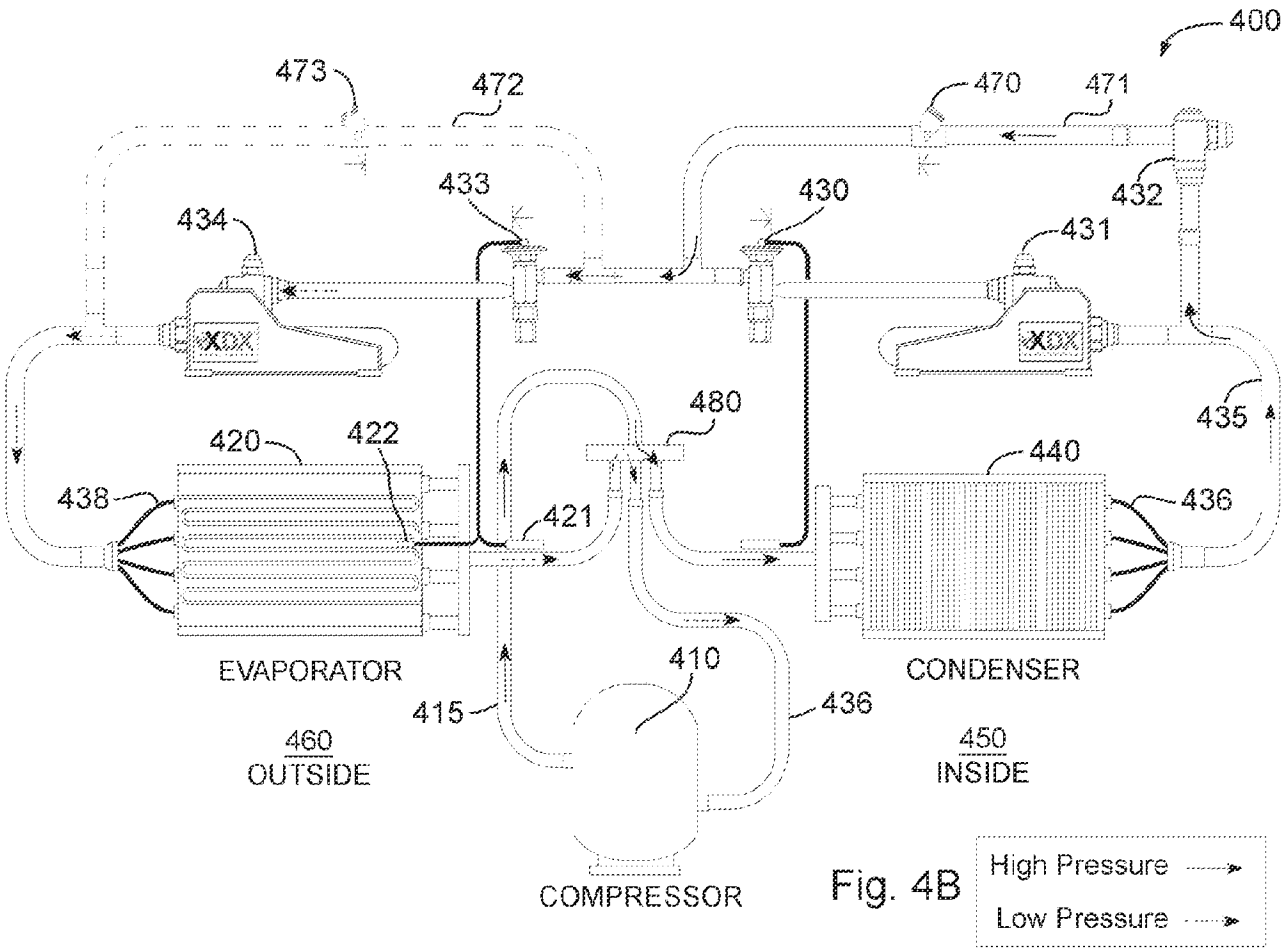
FIG. 4B depicts the schematic diagram of the heat pump system of FIG. 3B as modified with a phase separator capable of providing refrigerant to an outside heat exchanger during heating.

In FIG. 4A and FIG. 4B the surged cooling heat pump system 300 of FIG. 3A and FIG. 3B, respectively, is modified with a phase separator 434 providing refrigerant to an outside heat exchanger 420 during heating to provide a surged cooling and heating heat pump system 400. While the system 400 is depicted with a one-directional check valve 473 and bypass loop 472, these components are not necessary if metering device 433 provides bi-directional flow and the phase separator 434 is configured to not significantly affect refrigerant flow in the reverse direction. Thus, the system 400 provides surged operation for either heat exchanger serving as the evaporator. The system 400 may have fewer or additional components.

For example, while the system 400 is represented with phase separators feeding both an inside heat exchanger 440 and the outside heat exchanger 420, the phase separator feeding the inside heat exchanger 440 could be omitted to provide a surged heating heat pump system, albeit with the associated loss in cooling efficiency. While the system 400 also is depicted with a flow-regulating member 432 to provide the desired restriction to the expanded refrigerant transfer system 435 during heating, the flow-regulating member 432 may be omitted if the heating efficiency gained from surged operation of the evaporator (outside heat exchanger 420) during heating provides the desired heat to the conditioned space.

In the system 400 including both phase separators, the enhanced ability of an evaporator operating in surged mode to efficiently absorb heat is provided for both directions of heat transfer. In addition to the cooling benefits previously described with regard to the system 300 of FIG. 3A and FIG. 3B when the evaporator resides in the conditioned space, the system 400 of FIG. 4A and FIG. 4B adds the previously described benefits of surged operation for the evaporator residing outdoors during heating. Thus, the system 400 provides the benefits of increased heat transfer, decreased requirements for passive and/or active defrost, and the like to the outside heat exchanger 420 during heating, in addition to the inside heat exchanger 440 during cooling.

The reduced need for evaporator (outside heat exchanger 420) defrosting during heating is especially desirable in colder regions as the ability to operate the inlet of the outside heat exchanger 420 at a higher average temperature while adsorbing the same or greater amount of heat from the outdoor air allows the system 400 to transfer more heat to the conditioned space. Thus, a temperature measurement at the outlet of the outside heat exchanger 420 during heating will show a trace of refrigerant during surged operation (as previously discussed with regard to the system 300 during cooling). By monitoring the temperature and/or pressure with sensor 421 at the outlet of the outside heat exchanger 420, the metering device 433 may be adjusted to maintain surged operation within the outside heat exchanger 420. Thus, the system 400 requires fewer defrost cycles when used in colder regions where the average outdoor temperatures otherwise result in excessive frosting and/or the need for excessive active defrost cycles than for conventional systems. Surged evaporator operation during heating may allow for the installation of the system 400 in colder regions where conventional heat pump systems are impractical.

When the system 400 is operated in heating mode as represented in FIG. 4B, the substantially vapor surges of refrigerant provided to the initial portion of the outside heat exchanger 420 may be at least 50% vapor (mass vapor refrigerant/mass liquid refrigerant). The system 400 also may be operated to provide vapor surges of refrigerant that are at least 75% or at least 90% vapor to the initial portion of the outside heat exchanger 420. Such surges may result in the intermittent peak temperatures reached by the initial portion of the evaporator being within at most about 5° C. of the temperature of the second external medium 460. The intermittent peak temperatures reached by the initial portion of the evaporator also may be within at most about 2.5° C. of the temperature of the second external medium 460. These intermittent peak temperatures preferably may be warmer than the dew point of the outdoor air. Other intermittent peak temperatures may be reached.

When operated in heating mode as represented in FIG. 4B, the system 400 also may be operated to provide an average heat transfer coefficient from about 1.9 $Kcal_{th}$ $h^{-1}$ $m^{-2}$° $C.^{-1}$ to about 4.4 $Kcal_{th}$ $h^{-1}$ $m^{-2}$° $C.^{-1}$ from the initial portion to the outlet portion of the outside heat exchanger 420. The average heat transfer coefficient is determined by measuring the heat transfer coefficient at a minimum of 5 points from the beginning to the end of the outside heat exchanger coil and averaging the resulting coefficients. This heat transfer performance of the system 400 is a substantial improvement in relation to conventional non-surged heat pump systems where the initial portion of the outside heat exchanger has a heat transfer coefficient below about 1.9 $Kcal_{th}$ $h^{-1}$ $m^{-2}$° $C.^{-1}$ at the initial portion of the outside heat exchanger coil and a heat transfer coefficient below about 0.5 $Kcal_{th}$ $h^{-1}$ $m^{-2}$° $C.^{-1}$ at the portion of the outside heat exchanger before the outlet.

While the system 400 transfers heat to the conditioned space with greater efficiency than the conventional system 200, another factor, the temperature of the air provided to the conditioned space, also must be considered. For example, while 31° C. air having a relative humidity (RH) of 45% will warm a room to a desirable temperature, it may not feel warm to the skin. Thus, while operating the outside heat exchanger 420 in surged mode provides increased defrost and heat extraction efficiency in relation to a conventional heat pump system, the system 400 may not generate enough heat in a specific timeframe for the heated air to be at a temperature that feels warm when provided to the conditioned space. For example, if the system 400 can transfer enough heat to raise air temperature by approximately 35° C., an outdoor temperature of −10° C. will result in 25° C. air being provided to the conditioned space while an outdoor temperature of 5° C. will result in 40° C. air being provided to the conditioned space. While both will heat the conditioned space to an acceptable level, the 40° C. air will feel warm while the 27° C. air will not. Generally, people consider air at a temperature of about 50° C. and above to "feel warm enough".

While extra heat always may be generated at the inside heat exchanger 440 if the optional flow-regulating member 432 is used, relying on higher pressures from restricting refrigerant flow from the indoor heat exchanger 440 may not be desired due to the additional wear on the compressor 410 and the resulting energy loss. While common in conventional heat pump systems, generating additional "friction-heat" from operating a compressor against a greater than operationally required load is very energy inefficient. Similarly, extra heat also may be generated by using a larger compressor than otherwise required for cooling, however, operating efficiency again is lost Thus, while the system 400 may maximize the efficiency of heat transfer from the outside to the inside, it would be beneficial to transfer additional heat per unit time to the inside heat exchanger 440 to provide air than not only heats the conditioned space, but that feels warm during heating. While the system 400 can provide additional heat per unit time using one or more restrictions, such as the flow-regulating member 432, generating friction-heat shortens the operational life of the compressor 410 and is inefficient in relation to heat transferred from the outdoors.

One way of providing additional heat per unit time to the inside heat exchanger 440 is to monitor the temperature and/or pressure with senor 422 prior to the outlet of the outside heat exchanger 420. In this way the metering device 433 can be signaled to reduce flow, thus reducing surged operation of the evaporator to the portion of the evaporator before the sensor 422. While the senor 422 is located about half-way through the coil of the outside heat exchanger 420, the senor 422 may be placed anywhere before the outlet of the outside of the outside heat exchanger 420 that is compatible with the desired operation of the system 400. For example, the senor 422 also may be placed about one-third, or two-thirds from the inlet of the outside heat exchanger 420. One-third placement will result in about one-third of the evaporator operating in surged mode, while two-thirds placement will result in about two-thirds of the evaporator operating in surged mode.

As less than the full volume of the outside heat exchanger 420 is operating in surged mode (the substantial remainder of the coil is operating in superheat mode) when the metering device 433 is responding to the sensor 422 as opposed to the sensor 421, the efficiency of heat transfer from the outdoors to the conditioned space decreases. However, in this mode (partially surged outdoor evaporator operation), more heat may be transferred to the inside heat exchanger 440 per unit time due to the superheated portion of the evaporator. This superheated portion of the evaporator results in higher temperature, warmer feeling air being provided to the conditioned space.

By selecting which of the two sensors 421, 422 is used to control the metering device 433 during heating, the system 400 can be switched between highest heat transfer efficiency and higher temperature modes. Operating the system 400 in the higher temperature mode provided by partially surged and partially superheated evaporator operation may reduce or eliminate the need for additional friction-heat as generated by the compressor in response to the flow-regulating member 432. Furthermore, if the flow-regulating member 432 allows for adjustment during operation, the system 400 may be operated in highest heat transfer efficiency mode, or in higher temperature mode where additional heat comes from increased friction-heat (by adjusting flow-regulating member 432) and/or from reducing the percentage of surged operation within the outside heat exchanger 420.

Figure 5A:
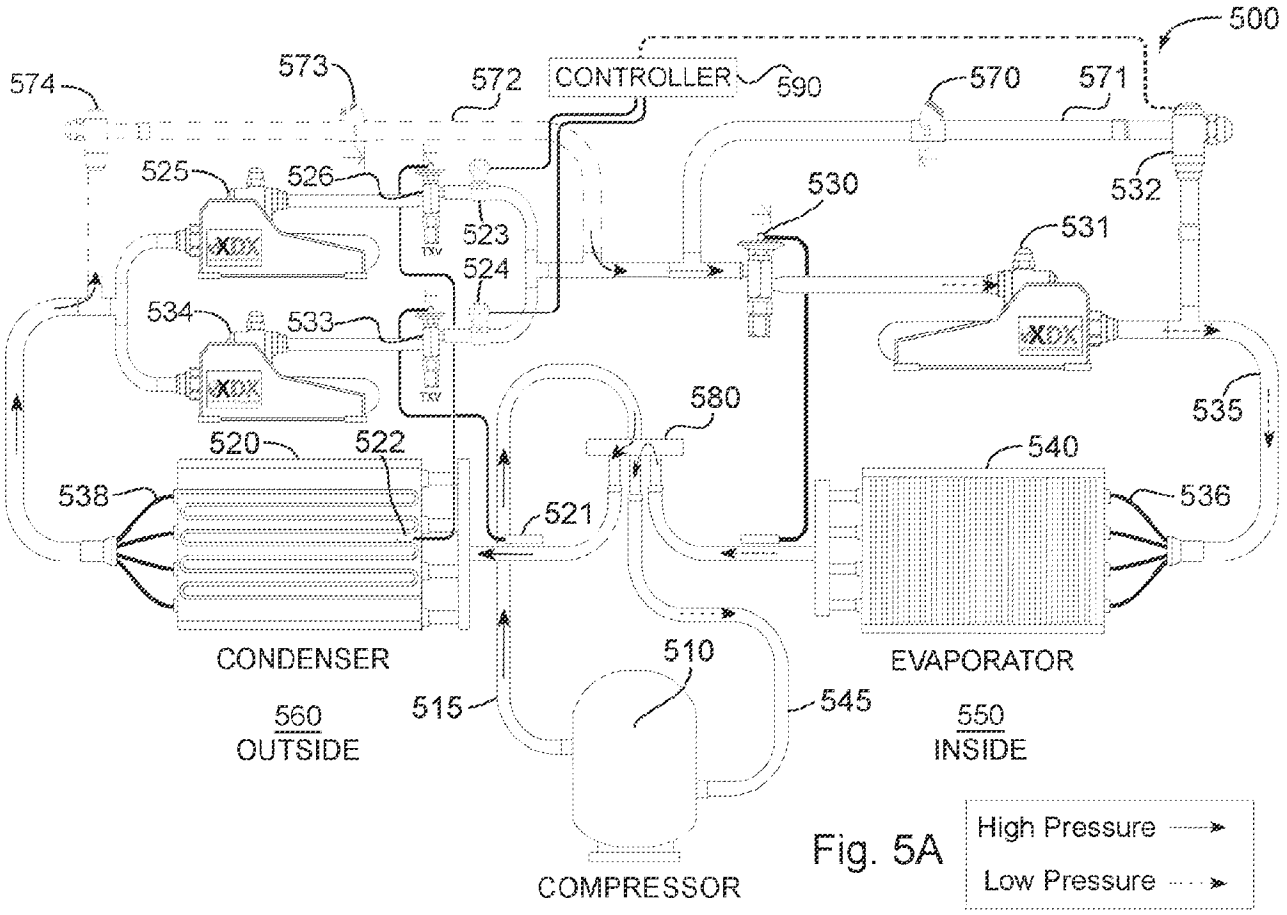
FIG. 5A represents a surged cooling and heating heat pump system having isolated full and partial surge circuits during cooling.
Figure 5B:
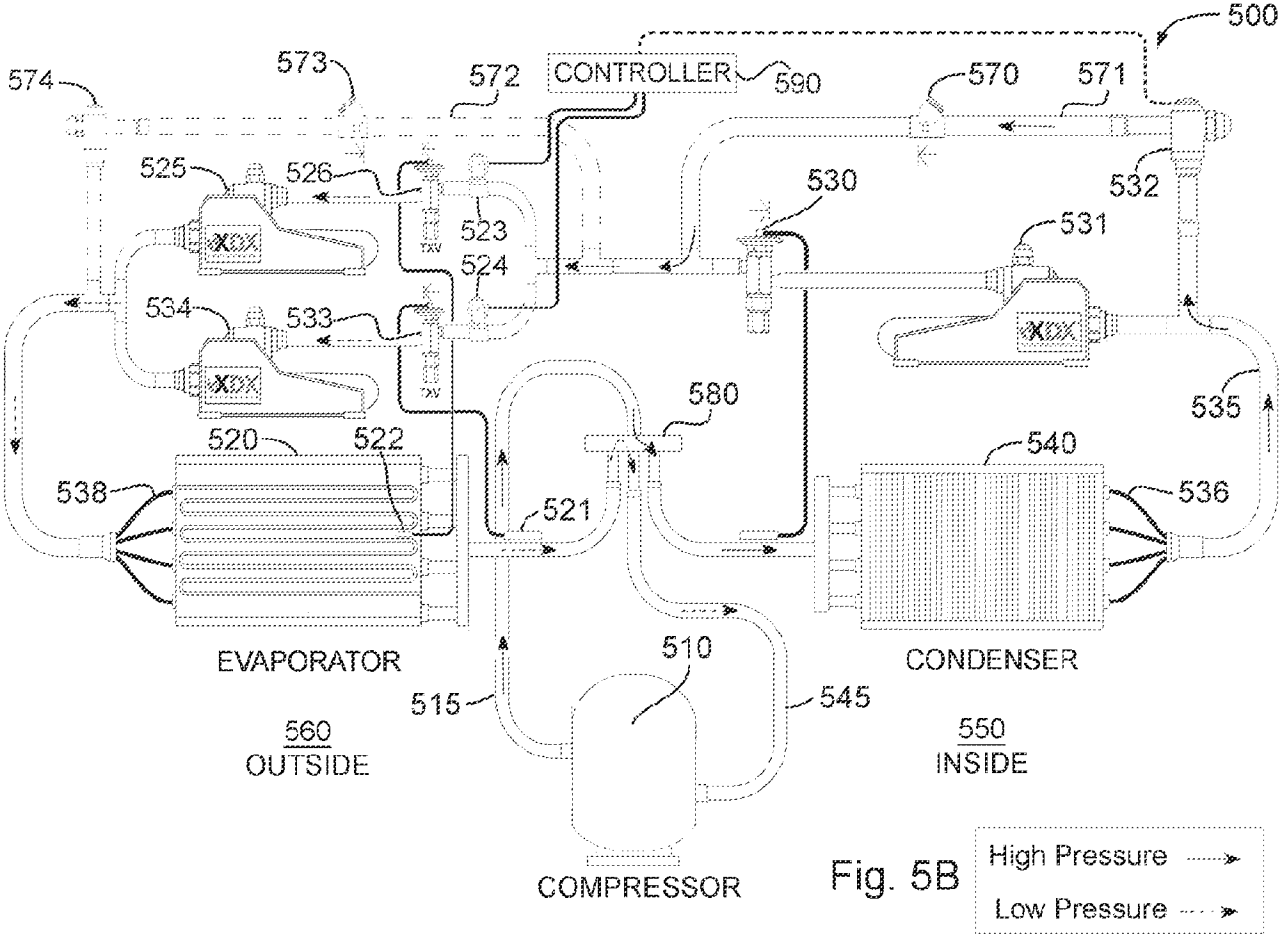
FIG. 5B represents a surged cooling and heating heat pump system having isolated full and partial surge circuits during heating.

FIG. 5A (cooling) and FIG. 5B (heating) represent a surged cooling and heating heat pump system 500 having isolated full and partial surge circuits. While a single outside heat exchanger 520 is shown, separate evaporators could be used for the full and partial surge circuits. In some instances, both fully surged and partially surged operation may not be practical when using a single phase separator, measuring device, and evaporator. Even when practical, it may be desirable to optimize each circuit for maximum performance which may not be possible with a single circuit system, such as the system 300.

In addition to the components of the system 300, the system 500 adds an additional phase separator 525 and an additional metering device 526. Sensor 521 controls metering device 533 to provide surged operation throughout all of the outside heat exchanger 520. Similarly, sensor 522 controls metering device 526 to provide partially surged operation throughout the outside heat exchanger 520. Electrically controlled on and off valves 523 and 524 control which surge circuit is operating at any one time. The valves 523, 524 may be omitted if the metering devices 526, 533, respectively, can substantially turn off the flow of refrigerant. Controller 580 may be programmed to determine when to open the valve 523 to provide partially surged higher temperature mode or to open the valve 524 to provide fully surged highest heat transfer efficiency mode during heating (FIG. 5B). If the metering devices 526, 533 can substantially turn off the flow of refrigerant, they may be controlled by the controller 580 to select the desired mode of operation.

The system 500 may be provided with an optional bypass loop 572 and one or both of an one-directional check valve 573 and a flow-regulating member 574 if one or more of the phase separators 525, 534; metering devices 526, 533, or valves 523, 524 are advantageously bypassed during cooling (FIG. 5A). Thus, if any of these devices cannot back-flow refrigerant efficiently during cooling, they may be bypassed. The flow-regulating member 574 may be used to optimize the flow of high-pressure refrigerant to a metering device 530 during cooling. As previously discussed with regard to systems 300 and 400, the system 500 may be optionally equipped with a bypass loop 571, one-directional check valve 570, and flow-regulating member 532 to bypass metering device 530 and phase separator 531 during heating. If the flow-regulating member 532 is electrically controlled, the controller 590 can vary the restriction that the compressor 510 must work against during heating to increase the temperature of the air provided to the conditioned space. Thus, the controller 590 can control the valves 523, 524 and the flow-regulating member 532 to provide the desired balance between heat transfer efficiency and the air temperature provided to the conditioned space. The system 500 may have fewer or additional components.

Figure 6:
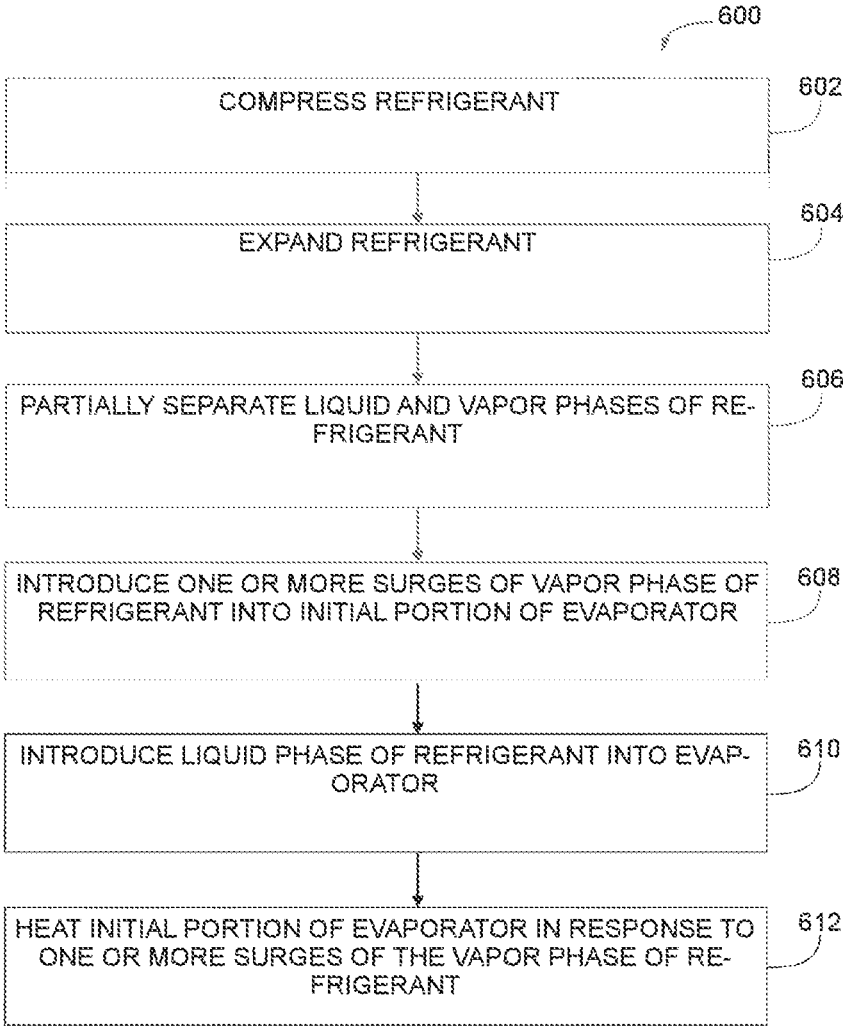
FIG. 6 depicts a flowchart of a method for operating a heat pump system.

FIG. 6 depicts a flowchart of a method 600 for operating a heat pump system including at least one phase separator as previously discussed. In 602, a refrigerant is compressed. In 604, the refrigerant is expanded. In 606, the liquid and vapor phases of the refrigerant are at least partially separated. In 808, one or more surges of the vapor phase of the refrigerant are introduced into the initial portion of an evaporator. The surges of the vapor phase of the refrigerant may include at least 75% vapor. The initial portion of the evaporator may be less than about 10% or less than about 30% of the volume of the evaporator. The initial portion may have other volumes of the evaporator. In 610, the liquid phase of the refrigerant is introduced into the evaporator.

In 612, the initial portion of the evaporator is heated in response to the one or more surges of the vapor phase of the refrigerant. The initial portion of the evaporator may be heated to less than about 5° C. of a temperature of a first or a second external medium. The initial portion of the evaporator may be heated to a temperature greater than a first or a second external medium. The initial portion of the evaporator may be heated to a temperature greater than a dew point temperature of a first or a second external medium. The temperature difference between the inlet and outlet volumes of the evaporator may be from about 0° C. to about 3° C. The heat pump system may be operated where a slope of the temperature of the initial portion of the evaporator includes negative and positive values. The initial portion of the evaporator may sublimate or melt frost. The frost may sublimate when the temperature of the initial portion of the evaporator is equal to or less than about 0° C.

Figure 7:
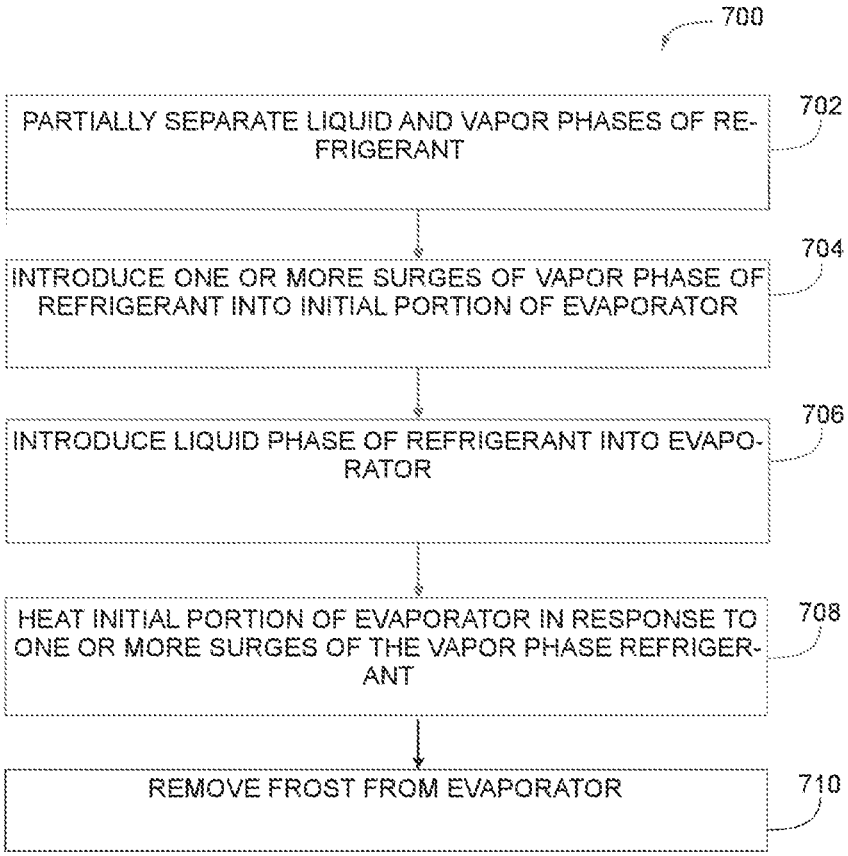
FIG. 7 depicts a flowchart of a method for defrosting an evaporator in a heat pump system.

FIG. 7 depicts a flowchart of a method 700 for defrosting an evaporator in a heat pump system including at least one phase separator as previously discussed. In 702, the liquid and vapor phases of the refrigerant are at least partially separated. In 704, one or more surges of the vapor phase of the refrigerant are introduced into the initial portion of an evaporator. The surges of the vapor phase of the refrigerant may include at least 75% vapor. The initial portion of the evaporator may be less than about 10% or less than about 30% of the volume of the evaporator. The initial portion may have other volumes of the evaporator. In 706, the liquid phase of the refrigerant is introduced into the evaporator.

In 708, the initial portion of the evaporator is heated in response to the one or more surges of the vapor phase of the refrigerant. The initial portion of the evaporator may be heated to less than about 5° C. of a temperature of a first or a second external medium. The initial portion of the evaporator may be heated to a temperature greater than a first or a second external medium. The initial portion of the evaporator may be heated to a temperature greater than a dew point temperature of a first or a second external medium. The temperature difference between the inlet and outlet volumes of the evaporator may be from about 0° C. to about 3° C. The heat transfer system may be operated where a slope of the temperature of the initial portion of the evaporator includes negative and positive values.

In 710, frost is removed from the evaporator. Remove includes substantially preventing the formation of frost. Remove includes essentially removing the presence of frost from the evaporator. Remove includes the partial or complete elimination of frost from the evaporator. The initial portion of the evaporator may sublimate or melt the frost. The frost may sublimate when the temperature of the initial portion of the evaporator is equal to or less than about 0° C.

Figure 8:
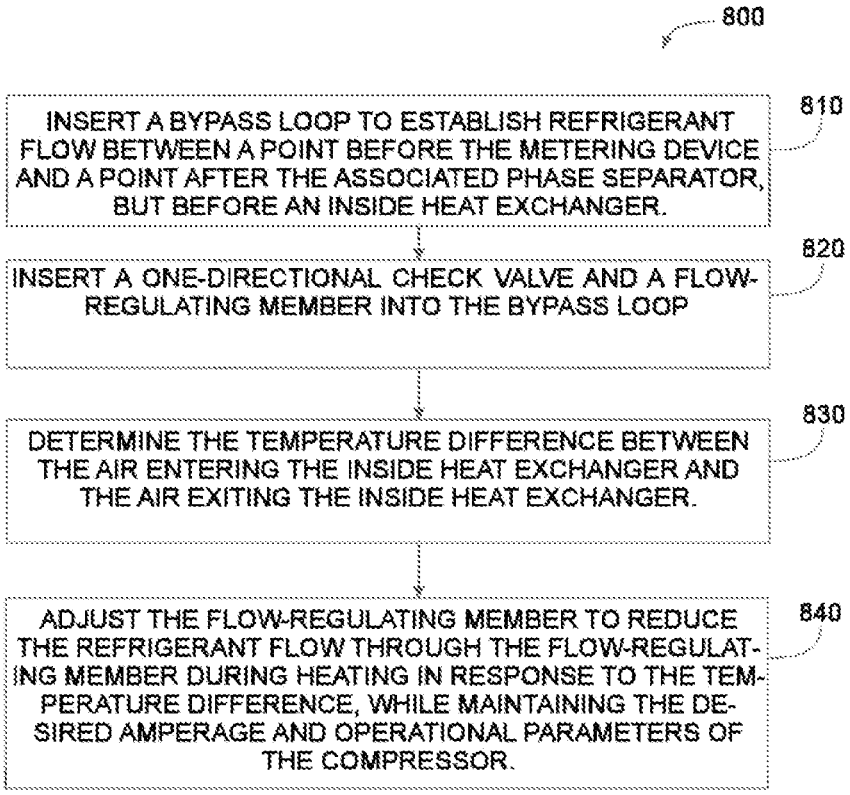
FIG. 8 depicts a flowchart of a method for bypassing a phase separator for heating operation.

FIG. 8 depicts a flowchart of a method 800 for bypassing a phase separator for heating operation. In 810, insert a bypass loop to establish refrigerant flow between a point before the metering device and a point after the associated phase separator, but before an inside heat exchanger. In 820, insert a one-directional check valve and a flow-regulating member into the bypass loop. Preferably, set the flow-regulating member where it provides the least restriction to refrigerant flow. In 830, determine the temperature difference between the air entering the inside heat exchanger and the air exiting the inside heat exchanger. In 840, adjust the flow-regulating member to reduce the refrigerant flow through the flow-regulating member during heating in response to the temperature difference, while maintaining the desired amperage and operational parameters of the compressor. Other components may be added to the system and additional adjustments made to provide the desired efficiency and air pressure.

For example, and generally in accord with the system of FIG. 2B, a conventional heat pump system was assembled from a vapor compressing unit and an inside heat exchanger. The vapor compressing unit was a Model HP29-0361P having a serial number of 5801D6259 and included a compressor, outside heat exchanger, fan, and associated controls. The compressor was single phase and rated to be safely used at 208 or 230 volts with a maximum recommended current draw of 21.1 Amps. The inside heat exchanger was a model number C23-46-1 serial number 6000K1267. When this system was operated in heating mode at about 208 volts, the compressor drew about 16.8 Amps while providing about 55.5° C. air to the conditioned space with an outside air temperature of about −9.4° C. The system maintained a conditioned space air temperature of about 23° C.

This conventional heat pump system was retrofitted with two phase separators to provide surged operation to the inside and outside heat exchangers. The retrofit was generally in accord with FIG. 4B, but with the omission of the bypass loop, one-directional check valve, and flow-regulating member for the phase separator providing surged operation to the inside heat exchanger. When this phase separator retrofitted system was operated in heating mode at about 208 volts, the compressor drew about 12.4 Amps while providing about 32.2° C. air to the conditioned space with an outside air temperature of about −9.4° C. The system maintained a conditioned space air temperature of about 23° C. Thus, while providing air of a lower temperature to the conditioned space in relation to the conventional system (about 32° C. vs. about 55° C.), the phase separator retrofitted system maintained the desired conditioned space air temperature of about 23° C. This highest heat transfer efficiency mode of heating operation reduced current draw from about 17 Amps to about 12 Amps, an approximately 30% reduction (17−12/17*100) in current draw, while maintaining the desired about 23° C. temperature of the conditioned space. Thus, a system having a phase separator providing surged operation to the outside heat exchanger during heating was able to heat the conditioned space to the desired temperature while drawing significantly less current than the conventional heat pump system.

The phase separator providing surged operation to the inside heat exchanger was then bypassed in accord with the method 800 and generally in accord with the system of FIG. 4B. Thus, the phase separator providing surged operation to the inside heat exchanger was bypassed while the phase separator providing surged operation to the outside heat exchanger was not. When this bypassed phase separator retrofitted system was operated in heating mode at about 208 volts, the compressor drew about 15.9 Amps while providing about 60° C. air to the conditioned space with an outside air temperature of about −9.4° C. The system maintained a conditioned space air temperature of about 23° C. Thus, the bypassed phase separator retrofitted system provided air of a higher temperature to the conditioned space than the conventional system (about 60° C. vs. about 55° C.), and maintained the desired conditioned space air temperature of about 23° C. This higher temperature mode of heating operation reduced current draw from about 17 Amps to about 16 Amps (an approximately 6% reduction (17–16/17*100)), while providing an approximately 8% increase (60–55.5/55.5*100) in the temperature of the air supplied to the conditioned space. Thus, a system having phase separators providing surged operation to the inside and outside heat exchangers with a bypass during heating operation was able to provide higher temperature air to the conditioned space while drawing less current than the conventional heat pump system.

What is claimed is:

1. A heat pump system, comprising:

a compressor having an inlet and an outlet, the inlet and the outlet in fluid communication with a flow reverser;

an outside heat exchanger having an inlet and an outlet;

an inside heat exchanger having an inlet, an initial portion, a later portion, and an outlet, the outlet of the compressor in fluid communication with the inlet of the outside heat exchanger, the outlet of the outside heat exchanger in fluid communication with the inlet of the inside heat exchanger, and the outlet of the inside heat exchanger in fluid communication with the inlet of the compressor;

a first metering device in fluid communication with the outside heat exchanger and the inside heat exchanger, where the first metering device expands a refrigerant into the inside heat exchanger, the refrigerant having vapor and liquid portions;

a first phase separator in fluid communication with the first metering device and the inside heat exchanger, where the first phase separator is operable to separate a portion of the vapor from the expanded refrigerant, and where the first phase separator is operable to introduce at least one surge of the vapor to the initial portion of the inside heat exchanger;

a second metering device in fluid communication with the outside heat exchanger and the inside heat exchanger, where the second metering device expands the refrigerant into the outside heat exchanger.

2. The system of claim 1, where the first phase separator has a body portion defining a separator inlet, a separator outlet, and a separator refrigerant storage chamber;

where the separator refrigerant storage chamber has a longitudinal dimension;

where a ratio of a diameter of the separator inlet to a diameter of the separator outlet is about 1:1.4 to 4.3 or about 1:1.4 to 2.1 and where a ratio of the diameter of the separator inlet to the longitudinal dimension is about 1:7 to 13.

3. The system of claim 1, where the at least one surge removes frost from the initial portion of the inside heat exchanger.

4. The system of claim 1, where the at least one surge sublimates frost from the initial portion of the inside heat exchanger, where the temperature of the initial portion of the inside heat exchanger is at most about 0° C.

5. The system of claim 1, where the first phase separator is operable to introduce at least two surges of the vapor to the initial portion of the inside heat exchanger during an operation cycle of the compressor.

6. The system of claim 1, where the initial portion of the inside heat exchanger is at most 30% of the total volume of the inside heat exchanger.

7. The system of claim 1, where the initial portion of the inside heat exchanger is at most 10% of the total volume of the inside heat exchanger.

8. The system of claim 1, where the at least one vapor surge introduced to the initial portion of the inside heat exchanger raises the initial portion of the inside heat exchanger to at least one intermittent temperature maximum within at most 5° C. of a temperature of a first external medium.

9. The system of claim 1, where the at least one vapor surge introduced to the initial portion of the inside heat exchanger raises the initial portion of the inside heat exchanger to at least one intermittent temperature maximum greater than the temperature of a first external medium.

10. The system of claim 1, where the at least one vapor surge introduced to the initial portion of the inside heat exchanger raises the initial portion of the inside heat exchanger to at least one intermittent temperature maximum greater than the dew point temperature of a first external medium.

11. The system of claim 1, where the temperature difference between the initial 10% of the volume of the inside heat exchanger and the last 10% of the volume of the evaporator is from 0° C. to 3° C.

12. The system of claim 1, where the at least one surge includes at least 75% vapor.

13. The system of claim 12, where a ratio of the diameter of the separator inlet to a refrigerant mass flow rate is about 1:1 to 1.

14. The system of claim 1, further comprising a first flow-regulating member in fluid communication with the inside heat exchanger and the second metering device.

15. The system of claim 14, further comprising a second phase separator in fluid communication with the second metering device and the outside heat exchanger.

16. The system of claim 14, further comprising a second phase separator in fluid communication with the second metering device and the outside heat exchanger and a third metering device in fluid communication with the outside heat exchanger and the inside heat exchanger, where the third metering device expands the refrigerant into a third phase separator, the third phase separator in fluid communication with the third metering device and the outside heat exchanger.

17. The system of claim 1, further comprising a second phase separator in fluid communication with the second metering device and the outside heat exchanger.

18. The system of claim 1, further comprising a second phase separator in fluid communication with the second metering device and the outside heat exchanger and a third metering device in fluid communication with the outside heat exchanger and the inside heat exchanger, where the third metering device expands the refrigerant into a third phase separator, the third phase separator in fluid communication with the third metering device and the outside heat exchanger.

19. The system of claim 18, further comprising a second flow-regulating member in fluid communication with the outside heat exchanger and the first metering device.

20. A method of bypassing at least one phase separator for heating operation, the method comprising:

inserting a bypass loop to establish refrigerant flow between a point before a metering device and a point after an associated phase separator, but before an inside heat exchanger;

inserting a one-directional check valve and a flow-regulating member into the bypass loop;

determining a temperature difference between air entering an inside heat exchanger and air exiting the inside heat exchanger; and adjusting the flow-regulating member to reduce the refrigerant flow through the flow-regulating member during heating in response to the temperature difference, while maintaining the desired amperage and operational parameters of a compressor supplying refrigerant to the flow-regulating member.

* * * * *